US007952600B2

(12) United States Patent
Kawada et al.

(10) Patent No.: US 7,952,600 B2
(45) Date of Patent: May 31, 2011

(54) IMAGE FORMING METHOD FOR FORMING IMAGES OF PLURAL COLORS ON AN IMAGE CARRIER AT ONCE

(75) Inventors: Kunihiro Kawada, Suwa (JP); Yujiro Nomura, Suwa (JP); Motomu Hayakawa, Suwa (JP); Teruyuki Inukai, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

(21) Appl. No.: 11/835,282

(22) Filed: Aug. 7, 2007

(65) Prior Publication Data

US 2008/0094464 A1 Apr. 24, 2008

(30) Foreign Application Priority Data

Jul. 26, 2006 (JP) ..... 2006-202668
Jan. 15, 2007 (JP) ..... 2007-005312

(51) Int. Cl.
*B41J 2/45* (2006.01)

(52) U.S. Cl. ..... 347/238

(58) Field of Classification Search ..... 347/238, 347/244, 258, 234, 235, 237, 247–250
See application file for complete search history.

(56) References Cited

U.S. PATENT DOCUMENTS 6,188,466 B1 * 2/2001 Iwasa et al. ..... 355/70
6,330,017 B1 * 12/2001 Suzuki ..... 347/238
6,798,440 B2 * 9/2004 Yasuda ..... 347/244

FOREIGN PATENT DOCUMENTS

JP 05261971 A 10/1993
JP 06278314 A 10/1994
JP 8-166555 6/1996
JP 2000190564 A 7/2000
JP 2001113745 A 4/2001
JP 2003-063139 3/2003
WO 03037635 A1 5/2003

* cited by examiner

*Primary Examiner* — Hai C Pham
(74) *Attorney, Agent, or Firm* — DLA Piper LLP (US)

(57) ABSTRACT

The invention provides an image forming apparatus and an image forming method capable of smoothly and reasonably conducting image formation in case of using a lens (lenses) of which optical magnification is minus. An image forming apparatus of the invention comprises: a line head having lenses of which optical magnification is minus and a light emitter array in which a plurality of light emitting elements are aligned. The lenses are plural in an axial direction (main scanning direction) of an image carrier and a direction (sub scanning direction) perpendicular to the axial direction. A light emitter block composed of "m×n" (in number) light emitting elements is disposed relative to each lens. The "m×n" light emitting elements comprises "n" (in number) light emitting element lines arranged in the direction perpendicular to the axial direction and each light emitting element line includes "m" (in number) light emitting elements aligned in the axial direction. The image forming apparatus further comprises: a control means for actuating the respective light emitting elements to emit lights to be inversed in the axial direction and the direction perpendicular to the axial direction to form an image on the image carrier. In this manner, images of plural colors are formed on the image carrier at once.

2 Claims, 23 Drawing Sheets

(1)Store data for the 1st line into memory (2)Read out data for the 4th line (3)Read out data for the 3rd line after a time T

IMAGE FORMING METHOD FOR FORMING IMAGES OF PLURAL COLORS ON AN IMAGE CARRIER AT ONCE

Japanese Patent Applications No. 2006-202668 filed Jul. 26, 2006 and No. 2006-5312 filed Jan. 15, 2007 of which the entire contents including specifications, drawings, and abstracts are incorporated herein by reference.

BACKGROUND

The present invention relates to an image forming apparatus and an image forming method capable of smoothly and reasonably conducting image formation in case of using a lens (lenses) of which optical magnification is minus.

Generally, a toner image forming means of electrophotographic type comprises a photoreceptor as an image carrier having a photosensitive layer on its outer surface, a charging means for uniformly charging the outer surface of the photoreceptor, an exposing means for selectively exposing the outer surface, uniformly charged by the charging means, to form an electrostatic latent image, and a developing means for applying a toner as a developer on the electrostatic latent image, formed by the exposure means, to form a visible image (toner image).

As a tandem-type image forming apparatus for forming a color image, there is an image forming apparatus of a type employing an intermediate transfer belt. The image forming apparatus comprises a plurality of (for example, four) toner image forming means as mentioned above which are disposed relative to the intermediate transfer belt. Toner images on the photoreceptors formed by the unicolor toner image forming means are transferred sequentially to the intermediate transfer belt so that the toner images of plural colors (for example, yellow, cyan, magenta, and black) are superposed on each other on the intermediate transfer belt, thereby forming a color image on the intermediate transfer belt.

In the tandem-type color image forming apparatus (printer), it is known to use a light emitter array as the exposure means (line head). For example, in an example disclosed in JP-A-2001-63139, light emitted from light emitting elements which are two-dimensionally aligned in a light emitter array is enlarged by a single lens and a photoreceptor is irradiated with the enlarged light to form a latent image. On the other hand, in an example disclosed in JP-A-8-166555, the writing position on an image surface (image carrier) is inverted from the position of a light emitting source by microlens arrays which are aligned in the longitudinal direction of an LED array chip.

SUMMARY

In the light emitter array described in JP-A-2001-63139, light outputted from a light emitting member 1 is inverted in the main scanning direction by a single lens 14 and is irradiated to a photoreceptive drum 15. That is, the single lens 14 is composed of a microlens of which optical magnification is minus. Therefore, this case is different from a case that light outputted from light emitting elements is irradiated to an image carrier in the optical axial direction, that is, the optical magnification is plus, like a SLA (SELFOC lens array).

In case of using a light emitter array provided with a microlens in an optical system as a line head as described in JP-A-2001-63139, a specified memory arrangement and a sequence of reading image data, for defining how to read out the image data stored in a memory to achieve desired printing, are required to smoothly conduct image formation. However, JP-A-2001-63139 describes only an arrangement using the single lens and does not describe a specified example of a memory arrangement and a sequence of reading out image data in case of using light emitting sources which are two-dimensionally aligned and using a plurality of lenses. In JP-A-8-166555, inversing the writing position on the image carrier in case of light emitting sources aligned linearly is just generally described. Therefore, there is a problem that it is not known how to handle and how to store data in a memory in case that light emitting elements in the light emitting source are two-dimensionally aligned.

The invention was made for solving the aforementioned problems of the prior arts. It is an object of the invention to provide an image forming apparatus and an image forming method capable of smoothly and reasonably forming an image in case of using a single lens of which optical magnification is minus. It is also an object of the present invention to provide an image forming apparatus and an image forming method capable of smoothly and reasonably forming an image in case using light emitting sources which are two-dimensionally aligned and using a plurality of lenses of which optical magnification is minus.

An image forming apparatus of the invention for achieving the aforementioned object, comprises: a line head having a light emitter array, including a plurality of light emitting element lines arranged in a direction (sub scanning direction) perpendicular to an axial direction of an image carrier, and lenses of which optical magnification is minus, each light emitting element line including a plurality of light emitting elements which are aligned in the axial direction (main scanning direction) of the image carrier, wherein said lenses are plural in the axial direction and in the direction perpendicular to the axial direction, and wherein a light emitter block composed of "m×n" (in number) light emitting elements is disposed relative to each lens, said "m×n" light emitting elements being aligned in "n" (in number) light emitting element lines arranged in the direction perpendicular to the axial direction, each light emitting element line including "m" (in number) light emitting elements aligned in the axial direction. The image forming apparatus is characterized by further comprising: a control means for inversing lights emitted from said respective light emitting elements in the axial direction and the direction perpendicular to the axial direction to form an image on said image carrier.

An image forming apparatus of the invention is characterized in that lights outputted from the "m×n" light emitting elements disposed relative to each lens arranged in the axial direction are controlled by said control means to form images to be aligned in a single line along said axial direction of said image carrier.

An image forming apparatus of the invention is characterized in that lights outputted from the "m×n" light emitting elements disposed relative to each lens arranged in said axial direction and the direction perpendicular to the axial direction are controlled by said control means to form images aligned in single lines extending along said axial direction of said image carrier wherein the single lines are plural in the direction perpendicular to the axial direction.

An image forming apparatus of the invention is characterized in that the (m×n)-th light emitting element of the light emitter block disposed relative to each lens is located at the front end in said axial direction of said light emitting array and on the first line in the direction perpendicular to said axial direction and the first light emitting element of said light emitter block is located at the rear end in said axial direction and on the (n)-th line in the direction perpendicular to said axial direction.

An image forming apparatus of the invention is characterized by further comprising a storing means for storing image data to be supplied to said respective light emitting elements, wherein said storing means stores image data in such a manner as to form images to be sequentially aligned in a single line along the axial direction from a writing start position in the axial direction of said image carrier.

An image forming apparatus of the invention is characterized in that said storing means stores image data in such a manner as to form images to be sequentially aligned in a single line along the axial direction from a writing start position in the axial direction of said image carrier, and wherein said single lines are plural in the direction perpendicular to said axial direction.

An image forming apparatus of the invention is characterized in that said control means reads out the image data stored in said storing means in the order of the (n)-th line, the (n−1)-th line, . . . the $1^{st}$ line of each light emitter block to actuate the corresponding light emitting elements.

An image forming apparatus of the invention is characterized in that said predetermined timing is determined based on the moving speed of said image carrier and the distance between said light emitting element lines in the direction perpendicular to said axial direction of the light emitting elements.

An image forming apparatus of the invention is characterized in that a plurality of said line heads are disposed for respective colors to form images of plural colors on the image carrier at once.

An image forming apparatus of the invention is characterized in that said light emitting elements are organic EL elements. Further, said lenses arranged in the sub scanning direction are displaced from one another in the main scanning direction.

An image forming apparatus of the invention comprises: a plurality of line heads for respective colors, wherein each line head has a light emitter array, including a plurality of light emitting element lines arranged in a direction (sub scanning direction) perpendicular to an axial direction of an image carrier, and a single lens of which optical magnification is minus, each light emitting element line including a plurality of light emitting elements which are aligned in the axial direction (main scanning direction) of the image carrier. The image forming apparatus is characterized by further comprising: a storing means for storing image data to be supplied to said respective light emitting elements, wherein assuming that a line on the upstream side of said image carrier is the $1^{st}$ line and a line on the downstream side is the $2^{nd}$ line, said storing means has a memory table in which the image data are stored in a state categorized into first data, to be supplied to light emitting elements on the light emitting element line for the second line, and second data to be supplied to light emitting elements on the light emitting element line for the first line, and further comprising: a control means for controlling said image data such that focused spots formed by said light emitting elements have positions inversed in said axial direction and such that, after a predetermined timing from the formation of focused spots on the image carrier by reading out said first image data or said second image data, focused spots having positions inversed in the direction perpendicular to said axial direction are formed by the other image data, thereby forming images of plural colors on the image carrier at once.

An image forming apparatus of the invention is characterized in that said control means forms focused spots aligned in a single line along said axial direction.

An image forming apparatus of the invention is characterized in that said predetermined timing is determined based on the moving speed of said image carrier and the distance between said light emitting element lines in the direction perpendicular to said axial direction of the light emitting elements.

An image forming apparatus of the invention is characterized in that said predetermined timing is adjusted finely by said control means.

An image forming apparatus of the invention is characterized in that the image data are stored in said memory table to form focused spots aligned in lines which are plural in the direction perpendicular to said axial direction of the image carrier. Further, said lenses arranged in the sub scanning direction are displaced from one another in the main scanning direction.

An image forming apparatus of the invention is characterized by further comprising at least two image forming stations each comprising said image carrier and an image forming unit around said image carrier, said image forming unit including a charging means, the line head, a developing means, and a transfer means, wherein a transfer medium passes through the respective image forming stations so as to conduct image formation of a tandem type.

Under a condition that line heads are provided relative to respective colors, each line head comprising a plurality of lenses of which optical magnification is minus and which are arranged in an axial direction of an image carrier and in a direction perpendicular to said axial direction and light emitter blocks each disposed relative to each lens, each light emitting element being composed of "m×n" (in number) light emitting elements, said "m×n" light emitting elements being aligned in "n" (in number) light emitting element lines arranged in the direction perpendicular to the axial direction, each light emitting element line including "m" (in number) light emitting elements aligned in the axial direction, an image forming method of the invention is characterized by comprising the following steps of: storing image data in a storing means in such a manner as to form images to be sequentially aligned in a single line along the axial direction from a writing start position in the axial direction of said image carrier and to form a plurality of said single lines in the direction perpendicular to said axial direction; reading out the image data stored in said storing means in such a manner as to form a latent image while sequentially turning on said light emitting elements starting from the downstream side in the moving direction of said image carrier; actuating light emitting elements according to said read out image data to emit lights to be inversed in said axial direction and the direction perpendicular to the axial direction; and forming images of four colors at once by exposing a plurality of said image carriers to light from said line heads each provided in each of said image carriers.

An image forming method of the invention is characterized in that said image data are read out in the order of the (n)-th line, the (n−1)-th line, . . . the $1^{st}$ line of each light emitter block.

An image forming method of the invention is an image forming method for forming images of plural colors on an image carrier at once. Under a condition that line heads are provided relative to respective colors, each line head comprising a light emitter array, including a plurality of light emitting element lines arranged in a direction perpendicular to an axial direction of the image carrier, and a single lens of which optical magnification is minus, each light emitting element line including a plurality of light emitting elements which are aligned in the axial direction of the image carrier, and a storing means for storing image data to be supplied to said light emitting elements is provided, the image forming method is characterized by comprising the following steps of:

inputting said image data into a memory table of said storing means in such a manner that, for each line of focused spots formed on the image carrier, focused spots are formed on said image carrier by said light emitting elements to have positions inversed in the axial direction and, assuming that a line on the upstream side of said image carrier is the $1^{st}$ line and a line on the downstream side is the $2^{nd}$ line, inputting said image data in a state categorized into first image data, to be supplied to light emitting elements on the light emitting element line for the second line, and second image data to be supplied to light emitting elements on the light emitting element line for the first line;

determining which line of said lines image data are read out;

reading out the first image data or the second image data corresponding to said determined line from said memory table to form focused spots on the image carrier;

reading out the other image data from said memory table after a predetermined timing, to form focused spots having positions inversed in the direction perpendicular to said axial direction on the image carrier; and forming focused spots aligned in a single line in the axial direction of said image carrier.

In an embodiment of the invention, image formation in case of using a single lens of which optical magnification is minus and using light emitting element lines which are plural in the sub scanning direction can be smoothly conducted by using a memory table having the aforementioned arrangement. The memory table can handle a special case of using a single lens of which optical magnification is minus to form focused spots, inversed from the positions of light emitting elements, on the image carrier and enables reasonable readout of image data.

According to the arrangement of the embodiment of the invention, smooth image formation is enabled using existing parameter, thereby preventing deterioration of image quality. The embodiment can also handle a case of forming images in a plurality of lines on the image carrier. In addition, since image data are stored in the storing means in a form suitably for the aforementioned image forming apparatus and the image data are read out from the storing means to actuate the light emitting elements to emit lights to be inversed in the axial direction and the direction perpendicular to the axial direction, a desired image prepared by a controller or the like can be formed exactly on the image carrier.

In an embodiment of the invention, an image forming apparatus employing a line head can smoothly and reasonably conduct the image formation. The line head comprises lenses which are plural in the axial direction (main scanning direction) of the image carrier and in the direction (sub scanning direction) perpendicular to the axial direction and light emitter blocks which are each composed of "m×n" (in number) light emitting elements and are each disposed relative to each lens, wherein the "m×n" light emitting elements are aligned in "n" (in number) light emitting element lines arranged in the sub scanning direction and each light emitting element line includes "m" (in number) light emitting elements aligned in the main scanning direction.

In an embodiment of the invention, a color image forming apparatus of a tandem type can smoothly conduct image formation in case of using a single lens or a plurality of lenses of which optical magnification is minus. An image forming apparatus having an intermediate transfer medium can smoothly conduct image formation in case of using a single lens or a plurality of lenses of which optical magnification is minus.

In an embodiment of the invention, organic EL elements are used as the light emitting elements. Since it is not necessary to reduce the diameter of a light emitting part, great power of the light emitting part is obtained. Therefore, organic EL material having lower luminous efficiency can be used.

DESCRIPTION OF EXEMPLARY EMBODIMENTS

Figure 2:
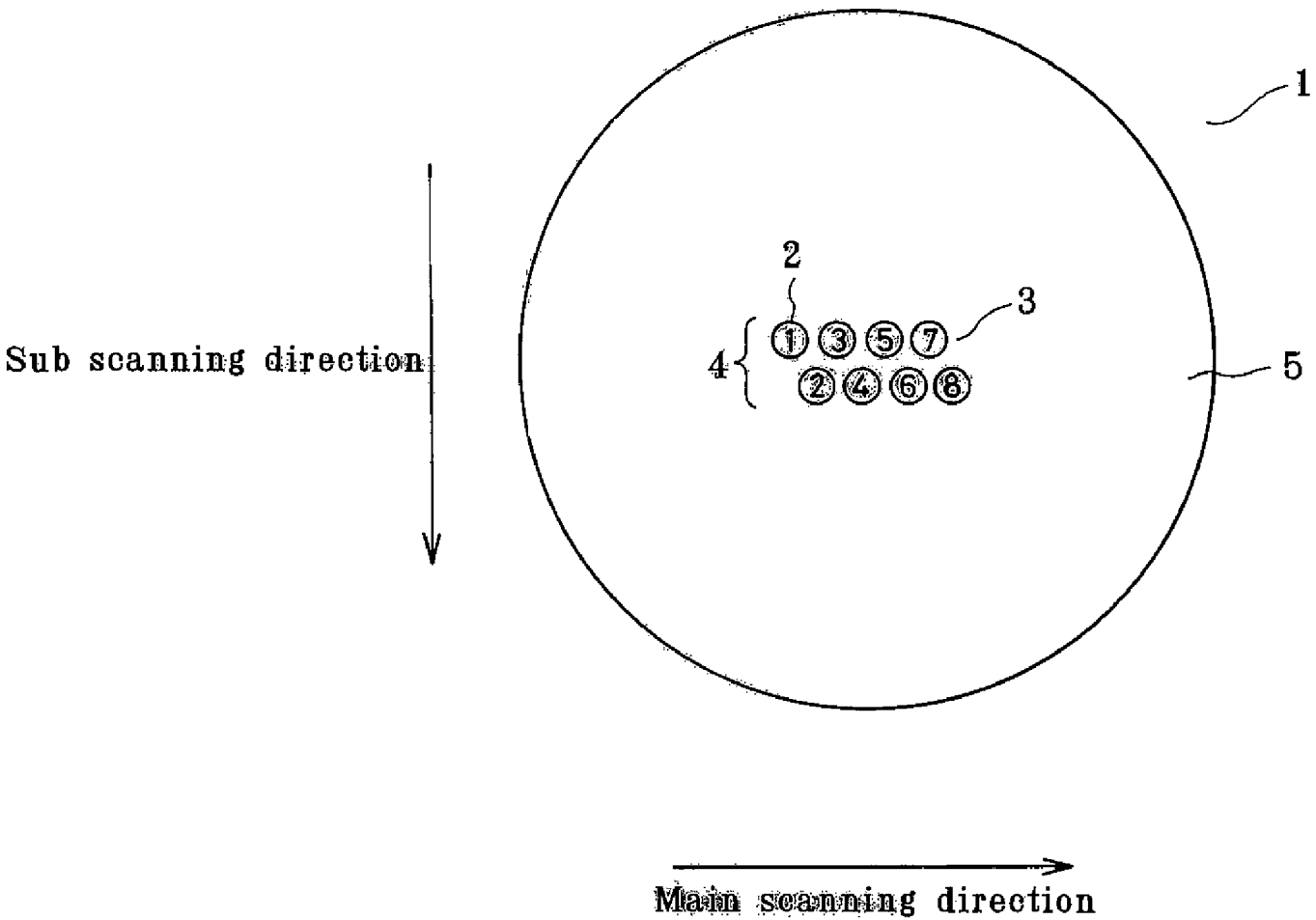
FIG. 2 is an illustration showing an embodiment of the invention.

FIG. 2 is a schematic illustration showing an example of a light emitter array used as a line head in an embodiment of the invention. In FIG. 2, the light emitter array 1 comprises a plurality of light emitting element lines 3 each including a plurality of light emitting elements 2 which are aligned in an axial direction (main scanning direction) of an image carrier (photoreceptor). The plurality of light emitting element lines 3 are arranged in a direction (sub scanning direction) perpendicular to the axial direction, thereby forming a light emitter block 4.

In the embodiment shown in FIG. 2, the light emitter block 4 has light emitting element lines 3 each including four light emitting elements 2 aligned in the main scanning direction, wherein the light emitting element lines 3 are two lines provided in the sub scanning direction. The first line is composed of odd-numbered light emitting elements and the second line is composed of even-numbered light emitting elements.

The light emitter block 4 is disposed relative to a microlens 5. As the light emitting elements 2, for example, organic EL elements are employed. Since it is not necessary to reduce the diameter of a light emitting part, the organic EL elements can provide great power of the light emitting part. Therefore, organic EL material having lower luminous efficiency can be used. Light outputted from the respective light emitting elements is inverted in the main scanning direction by the microlens 5 and is incident on the image carrier.

Figure 3:
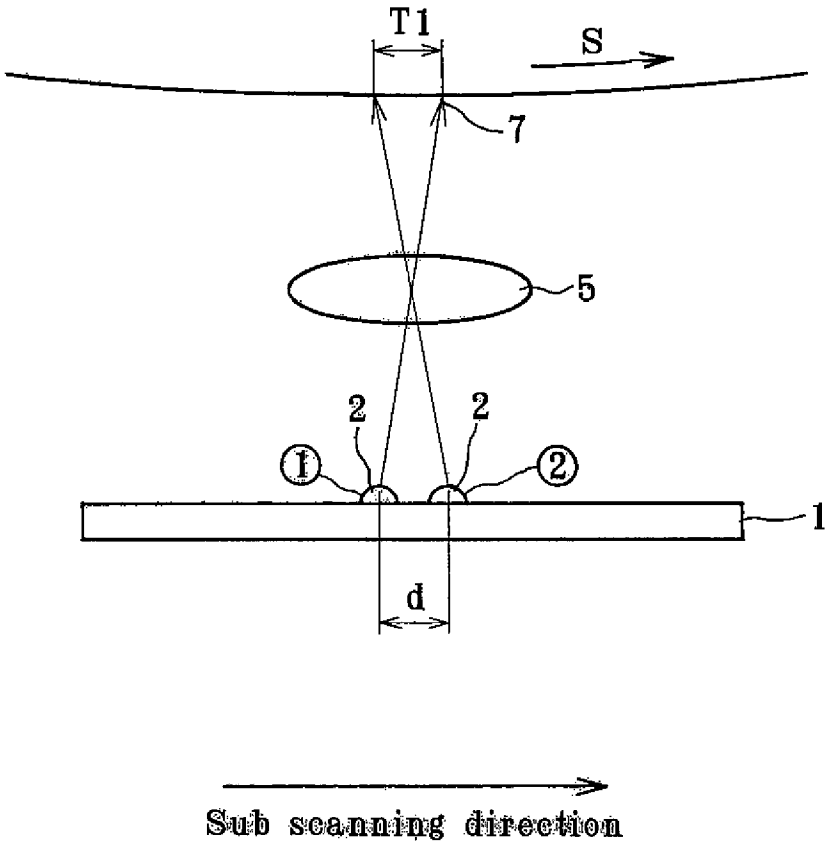
FIG. 3 is an illustration showing the embodiment of the invention.

The light outputted from the respective light emitting elements is inverted also in the sub scanning direction by the microlens 5 and is incident on the image carrier. Description will be made as regard to this point with reference to FIG. 3. FIG. 3 is an illustration showing positions of focused spots in case that output lights of the respective light emitting elements 2 are incident on an exposure surface 7 of the image carrier through the microlens 5 in the structure shown in FIG. 2. In FIG. 3, since the optical magnification of the microlens 5 is minus, the focused positions 7 on the image carrier by irradiation of output lights of the light emitting elements are positions inverted from the positions of the light emitting elements both in the main scanning direction and the sub scanning direction.

That is, a light outputted from a light emitting element, numbered with ①, which is arranged at an upstream side in the sub scanning direction in FIG. 2 is focused on a focused spot on the image carrier 7 at a downstream side in the sub scanning direction. In addition, a light outputted from a light emitting element, numbered with ②, which is arranged at a downstream side in the sub scanning direction is focused on a focused spot on the image carrier 7 at an upstream side in the scanning direction. In FIG. 3, "S" is the moving speed of the image carrier, "d" is a distance in the sub scanning direction between the light emitting elements, and "T1" is the time taken for movement of the image carrier corresponding to timing for reading out memory addresses as will be described later.

When the plurality of light emitting element lines 3 are arranged relative to the microlens 5 as shown in FIG. 2, a plurality of lines of focused positions on the image carrier as a focusing object are formed in the sub scanning direction as described with reference to FIG. 3. The embodiment of the invention is structured such that a single line of focused spots in the main scanning direction of the image carrier even when the plurality of light emitting element lines 3 are arranged relative to the microlens 5 as shown in FIG. 2.

In order to form the focused spots aligned in a single line in the main scanning direction of the image carrier, it is required to control the timing of light emission of the light emitting elements (odd-numbered) on the first line of FIG. 2 and the timing of light emission of the light emitting elements (even-numbered) on the second line. In consideration of inversion of the positions of focused spots in the sub scanning direction, the timings are controlled such that the light emitting elements on the second line first emit lights and then the light emitting elements on the first line emit lights.

Figure 1A:
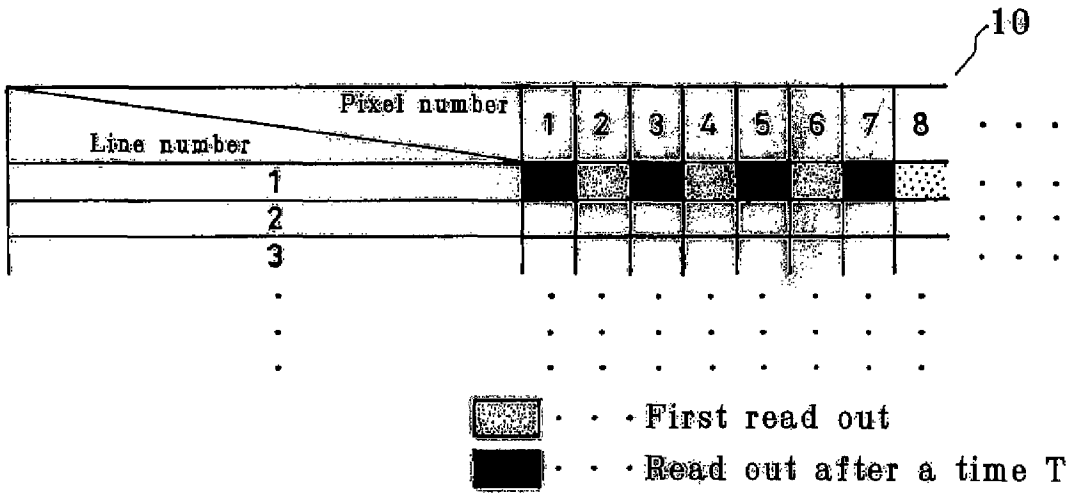
FIGS. 1(*a*) and 1(*b*) are illustrations showing an embodiment of the invention.
Figure 1B:
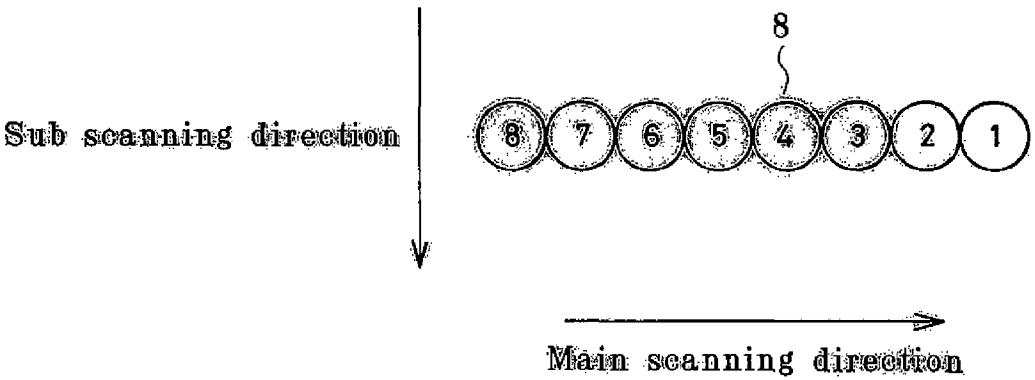

FIGS. 1(*a*)-1(*b*) are illustrations relating to this embodiment of the invention. FIG. 1(*a*) shows a table of a line buffer memory for storing image data. The column index of the memory table indicates pixel numbers (corresponding to the numbers of the light emitting elements shown in FIG. 2) and the row index of the memory table indicates the numbers of lines (the lines of focused spots formed on the image carrier). FIG. 1(*b*) shows the positions of the focused spots formed on the image carrier. The numbers of the focused spots correspond to the numbers of the light emitting elements shown in FIG. 2.

The first image data (2, 4, 6, 8) corresponding to the light emitting elements in the second line of the light emitting element group shown in FIG. 1(*a*) among the image data stored in the line buffer memory are read out to make the light emitting elements to emit lights. After a time T1, the second image data (1, 3, 5, 7) corresponding to the light emitting elements in the first line stored in the memory addresses are read out to make the light emitting element to emit lights. The lights outputted from the light emitting elements are inverted in the main scanning direction by the microlens and are incident on the image carrier.

In this manner, the focused spots of the first line on the image carrier are formed in the same line as the focused spots of the second line in the main scanning direction. That is, as shown in FIG. 1(*b*), the focused spots 8 of which positions are inverted from the positions of the light emitting elements in the main scanning direction and which are aligned in a line are formed on the image carrier. As for the pixel numbers indicated on the column index, the even numbers of the memory addresses correspond to the light emitting elements (even-numbered) of the second light emitting element line of FIG. 2. The odd numbers of the memory addresses correspond to the light emitting element (even-numbered) of the first light emitting element line.

When there are a plurality of lines of focused spots formed on the image carrier, the following processes are taken. For example, the read-out procedure when the aforementioned time T1 corresponds to the time taken for the image carrier to move a distance corresponding to a single line in the sub scanning direction is as follows: (1) reading out image data corresponding to light emitting elements (even-numbered) on the second line for a line 1 and making the light emitting elements to emit lights; (2) reading out image data corresponding to light emitting elements (odd-numbered) on the first line for the line 1 and reading out image data corresponding to light emitting elements (even-numbered) on the second line for a line 2 and making the respective light emitting elements to emit lights; and (3) repeating the aforementioned process (2).

In the embodiment of the present invention, the table arrangement of the memory storing image data to be supplied to the respective light emitting elements is designed to respond to a case that a plurality of lines of light emitting elements are provided in the sub scanning direction relative to the single microlens. That is, the memory addresses are divided into an even number group and an odd number group. For example, image data in the even number group are read out at once and are transmitted to the corresponding light emitting elements. After a predetermined time, image data in the odd number group are read out at once and are set to the corresponding light emitting elements.

The image data in the even number group and the odd number group are sorted to be sent to the light emitting elements lines which are plural in the sub scanning direction relative to the single microlens. Considering that the focused spots on the image carrier are inversed ones of the light emitting elements in the main scanning direction, the places of image data in the memory address are set. By setting the arrangement of the memory table and the timings of reading out image data from the memory table as mentioned above, the focused spots can be formed in a single line in the main scanning direction of the image carrier when light emitting element lines which are plural in the sub scanning direction are formed relative to the single microlens. Though the aforementioned description was made as regard to the arrangement in which the light emitting element lines formed relative to the single microlens are two in the sub scanning direction, an arrangement in which the light emitting element lines are three or more in the sub scanning direction may be employed.

Figure 4:
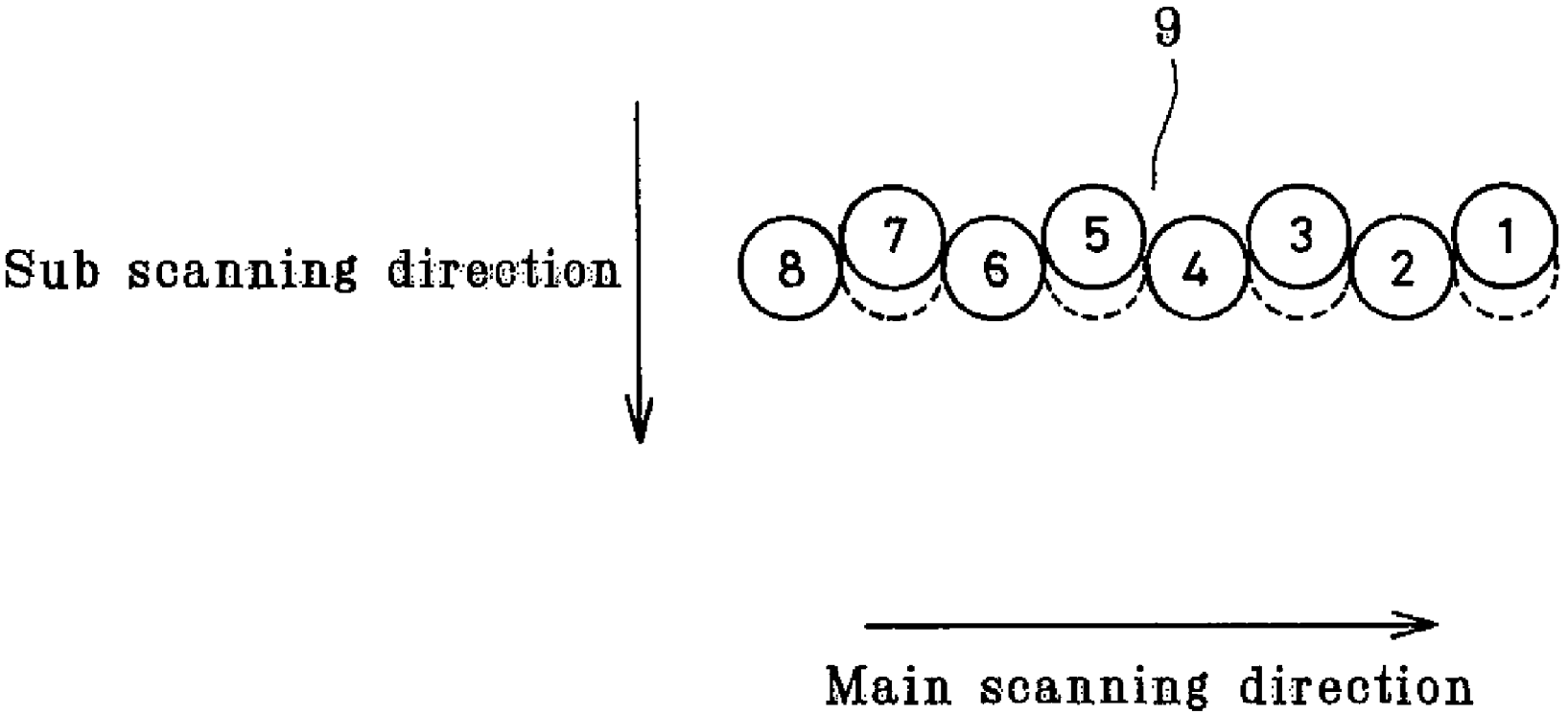
FIG. 4 is an illustration showing the embodiment of the invention.

FIG. 4 is an illustration for the embodiment of the present invention. FIG. 4 shows focused spots 9 on the image carrier in case of misalignment of the microlens. Since the time T1 is instable due to variation in speed S of the image carrier, differences in distance "d" in the sub scanning direction between the light emitting elements, and/or optical adjustment variation, the time T1 slightly varies even when the time T1 is set to a time corresponding to a single line, as shown in FIG. 4.

Accordingly, the focused spots of the first line and the focused spots of the second line are misaligned so that the line of the focused spots is distorted as shown in FIG. 4. That is, this leads to deterioration of image quality. For this, the time T1 is allowed to be fine adjusted so as to compensate such slight misalignment. The time T1 can be calculated by the following equation:

$$T1=|(d\times\beta)/S|$$

where the above parameters are as follows:

d: distance in the sub scanning direction between light emitting elements;

S: moving speed of focused image surface (image carrier)

β: magnification ratio of lens

Figure 5:
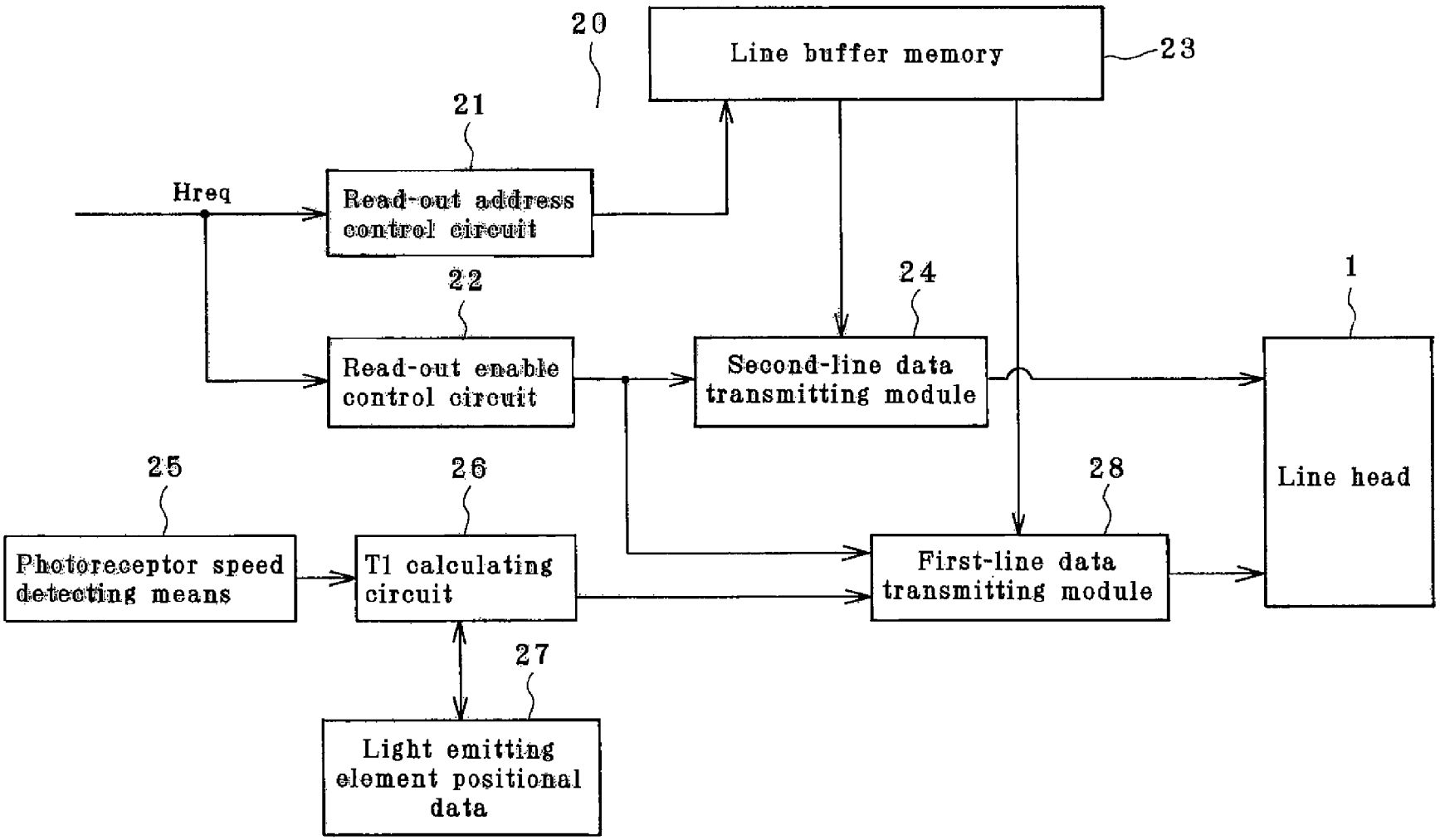
FIG. 5 is a block diagram showing the embodiment of the invention.

FIG. 5 is a block diagram showing the embodiment of the invention. In FIG. 5, a control unit 20 has a line buffer memory 23 which stores image data, and a read-out address control circuit 21 which determines a read-out address in the line buffer (memory) based on Hreq signal (horizontal read-out request). According to a signal from the read-out address control circuit 21, even-numbered image data (the second line) and odd-numbered image data (the first line) as described with reference to FIG. 1(*a*) are read out from the memory address.

A read-out timing calculating circuit 26 calculates read-out timing time T1 based on a signal from an image carrier (photoreceptor) speed detecting means 25 and positional data 27 about distance "d" in the sub scanning direction between light emitting elements. Based on the Heq signal, a read-out enable control circuit 22 generates a read-out enable signal. According to the read-out enable signal of the read-out enable control circuit 22, a second-line data transmitting module 24 reads out data for the second line shown in FIG. 1 from the memory and transmits the data to the line head to make the light emitting elements to emit lights.

After the time T1 from the read-out enabling process for the second line, a first-line image data transmitting module 28 reads out data for the first line shown in FIG. 1 from the memory and transmits the data to the line head to made the light emitting elements to emit lights. The line head (light emitter array) 1 receives the image data from the second-line data transmitting module 24 and the first-line image data transmitting module 28 and makes the light emitting elements to emit lights.

Figure 6:
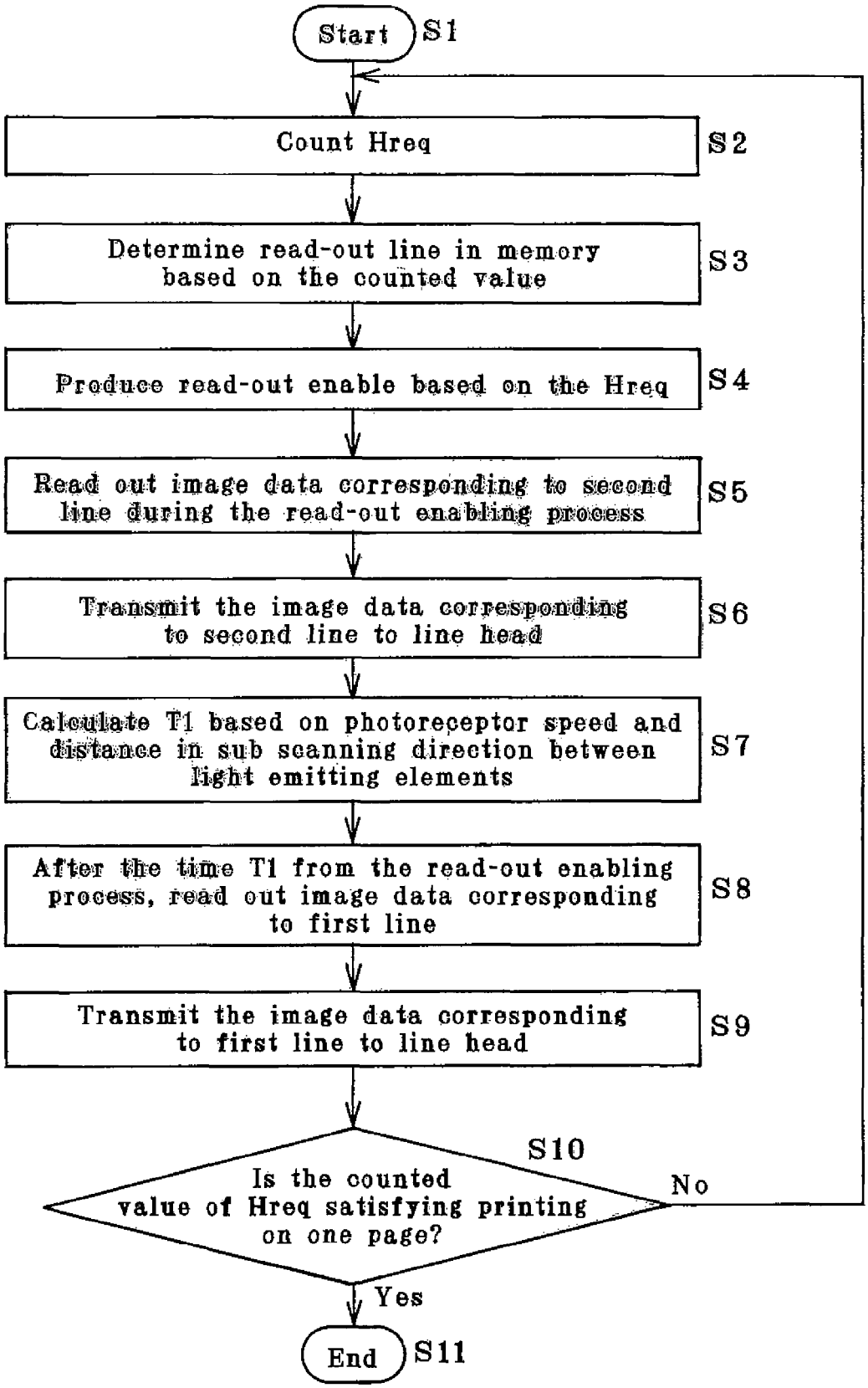
FIG. 6 is a flow chart showing a procedure of the invention.

FIG. 6 is a flow chart showing a procedure of the invention. Hereinafter, description will now be made as regard to this flow chart. As the procedure is started (S1), Hreq signals are counted (S2). Then, based on the counted value of the Hreq signals, read-out lines in the memory are determined (S3). Read-out enable is produced based on the Hreq signals (S4). During the read-out enabling process, the image data corresponding to the second line are read out (S5) and are transmitted to the line head (S6).

Based on the image carrier (photoreceptor) speed S and the distance "d" in the sub scanning direction between the light emitting elements, a read-out timing time T1 is calculated (S7). After the time T1 from the read-out enabling process, the image data corresponding to the first line are read out (S8) and are transmitted to the line head (S9). Then, it is determined whether or not the counted value of Hreq signals is a value satisfying printing on one page (S10). If the determination result is Yes, the procedure is terminated (S11). If the determination result is No, the procedure is returned to the step (S2).

Figure 7:
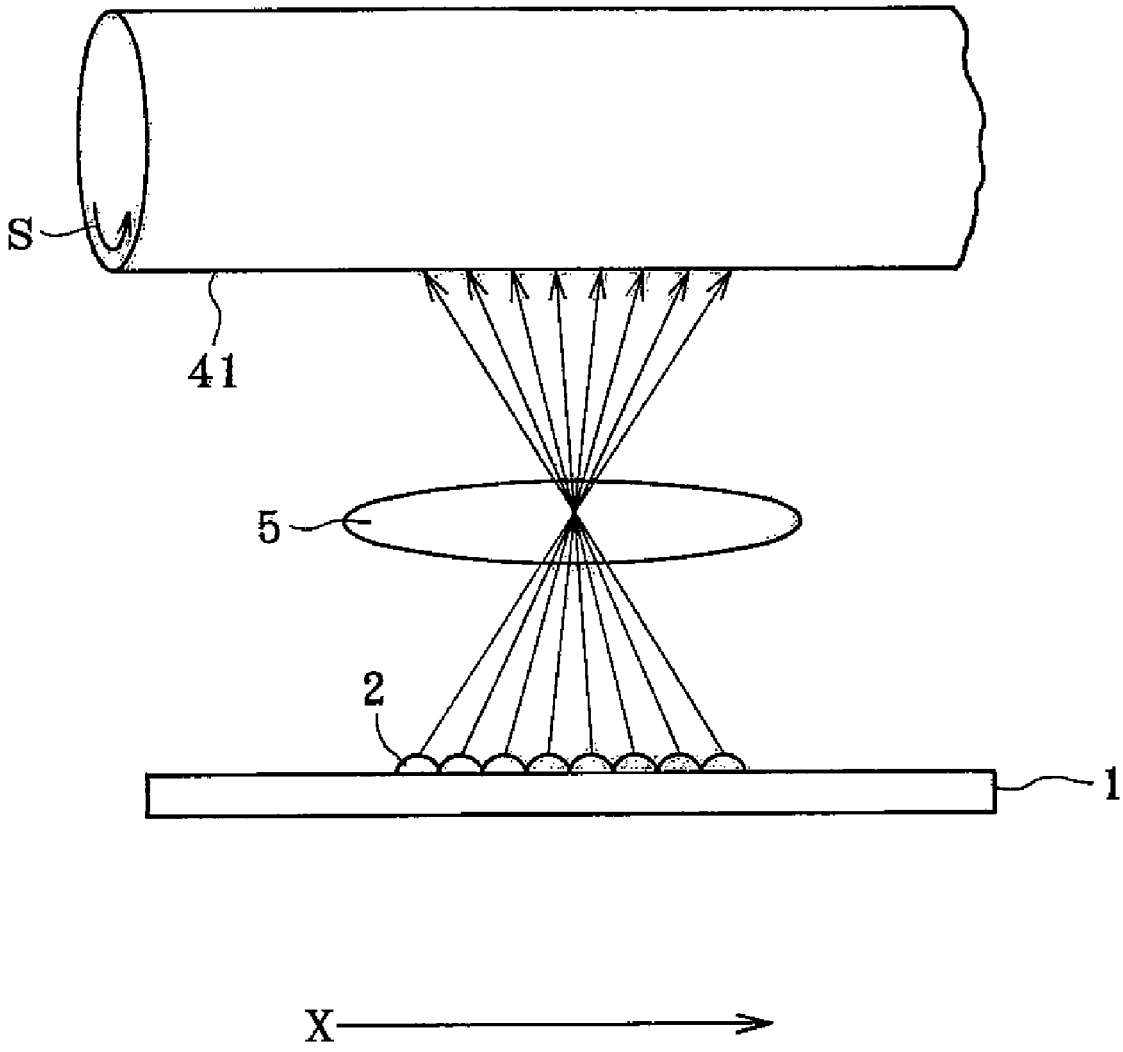
FIG. 7 is an illustration showing an embodiment of the invention.
Figure 8:
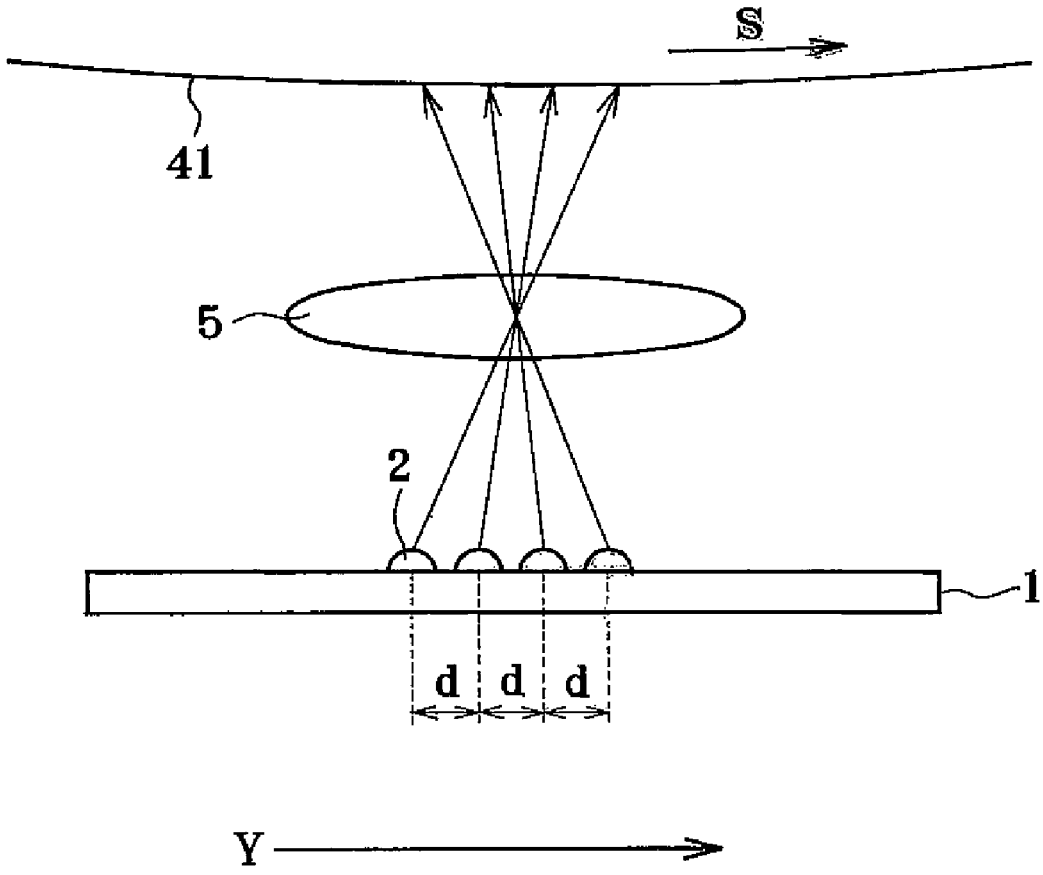
FIG. 8 is an illustration showing the embodiment of the invention.

The aforementioned description was made as regard to the case in which light emitting element lines which are two in the sub scanning direction are arranged relative to the microlens, wherein each light emitting element line is composed of four light emitting elements 2 in the main scanning direction. In the embodiment of the invention, however, light emitting element lines which are more than two may be arranged relative to the microlens 5. FIG. 7 and FIG. 8 show an embodiment in which light emitting element lines which are four in the sub scanning direction are arranged, wherein each light emitting element line is composed of eight light emitting elements in the main scanning direction. Numeral 41 designates an image carrier which moves in a direction of arrow at a speed S. Also in the embodiment shown in FIG. 7 and FIG. 8, focused spots are formed on the image carrier 41 at positions inversed from the positions of light sources in the main scanning direction and the sub scanning direction.

Figure 17:
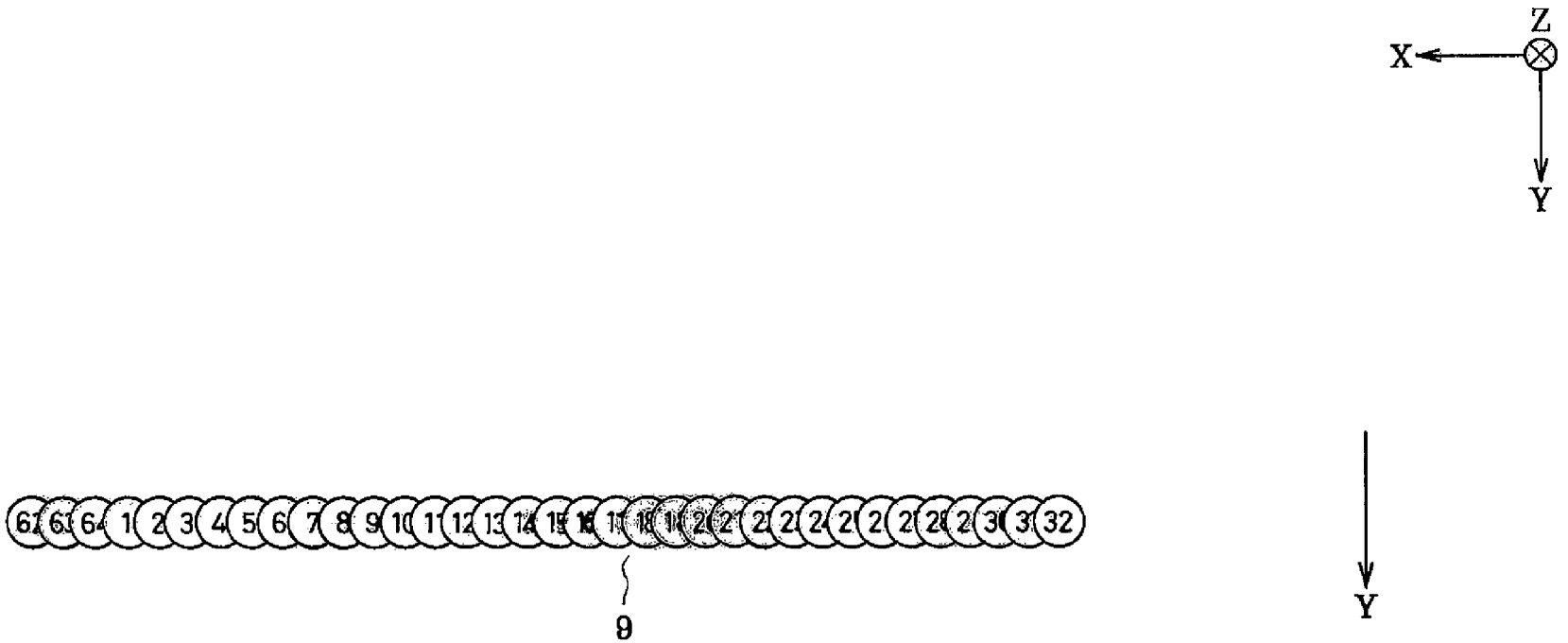
FIG. 17 is an illustration showing the embodiment of the invention.
Figure 18:
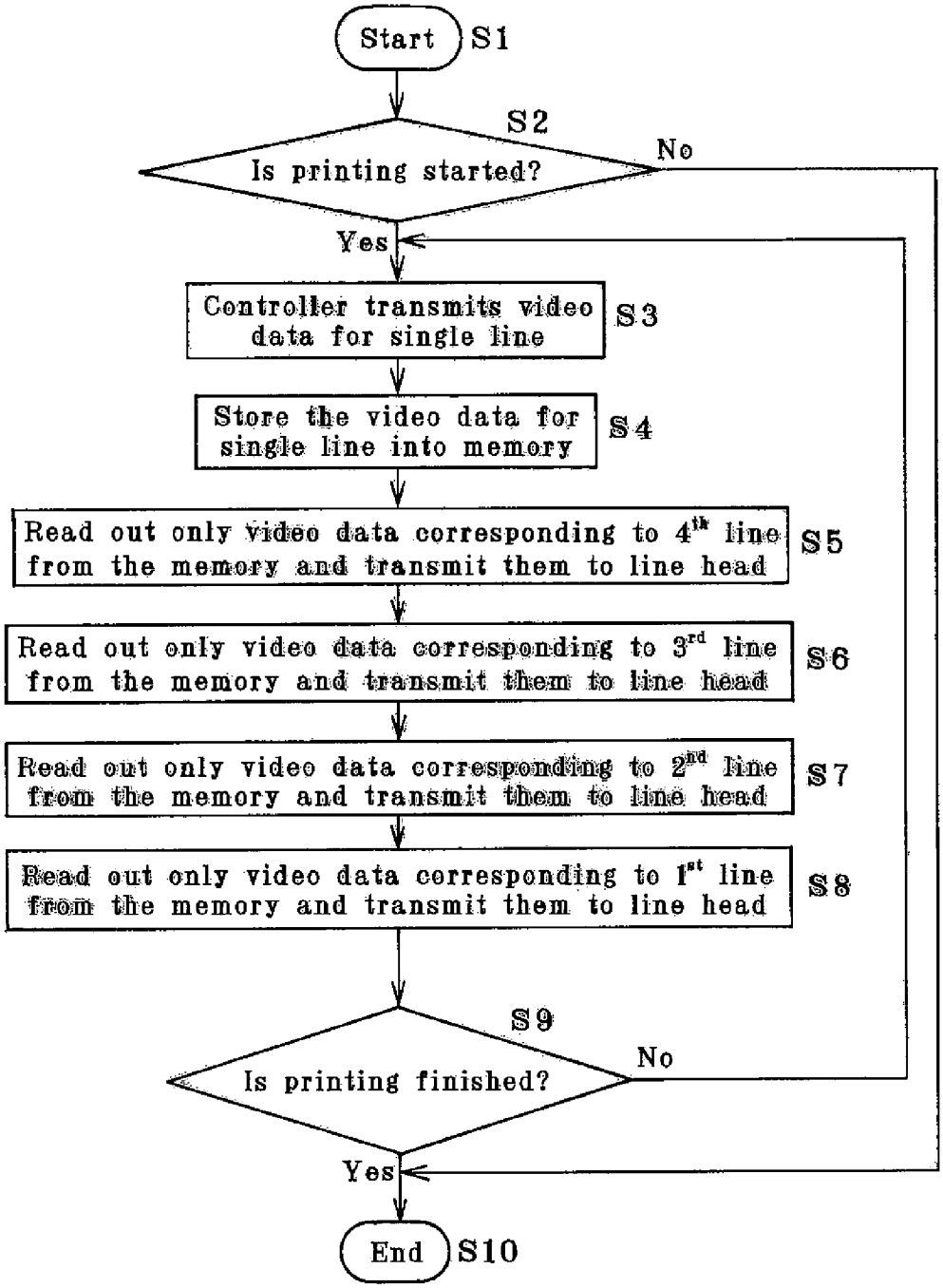
FIG. 18 is a flow chart showing a proceeding procedure of the invention.

In an embodiment of the invention, a plurality of microlenses are arranged in the main scanning direction and the sub scanning direction of a light emitter array used as a line head based on the embodiment described with reference to FIG. 1 through FIG. 6. When a plurality of light emitting elements are arranged in a matrix state in the main scanning direction and the sub scanning direction in each microlens 5, image data are written in a table of the memory in order to enable smooth image formation on the image carrier. Hereinafter, the embodiment of the invention will be described with reference to illustrations in FIG. 9 through FIG. 17, a flow chart in FIG. 18, illustrations for memory arrangement in FIGS. 19(*a*)-19(*c*) and FIGS. 20(*d*)-20(*e*), and block diagrams in FIG. 21 and FIG. 22.

Figure 9:
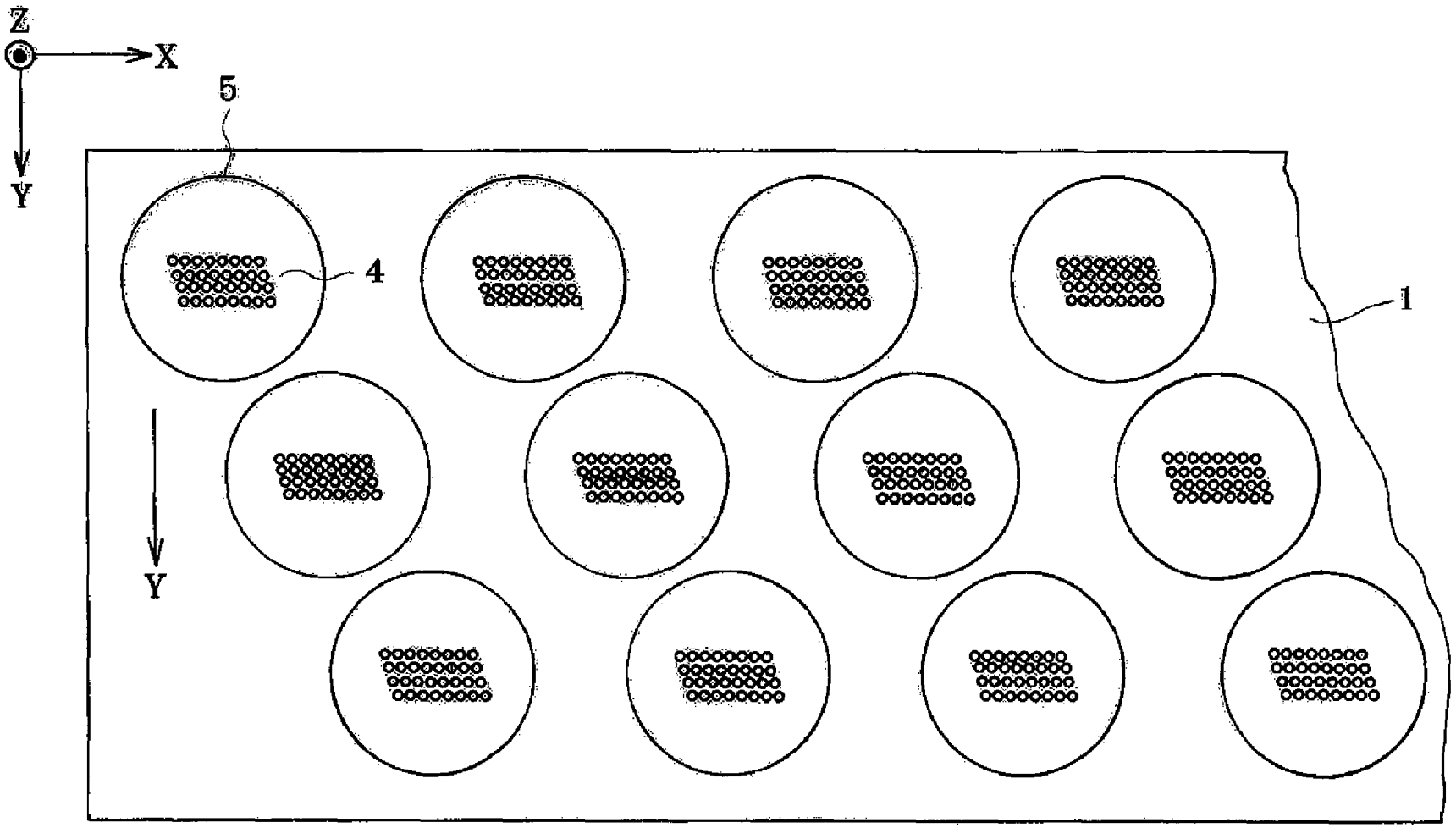
FIG. 9 is an illustration showing the embodiment of the invention.

FIG. 9 shows an example in which a plurality of microlenses 5 are arranged in the main scanning direction and the sub scanning direction of the light emitter array 1. In each microlens 5, a light emitter block 4 is formed. The light emitter block 4 comprises four light emitting element lines provided in the sub scanning direction. Each light emitting element line comprises eight light emitting elements in the main scanning direction. In the light emitter block 4, plural light emitting elements are arranged in a matrix state.

Figure 11:
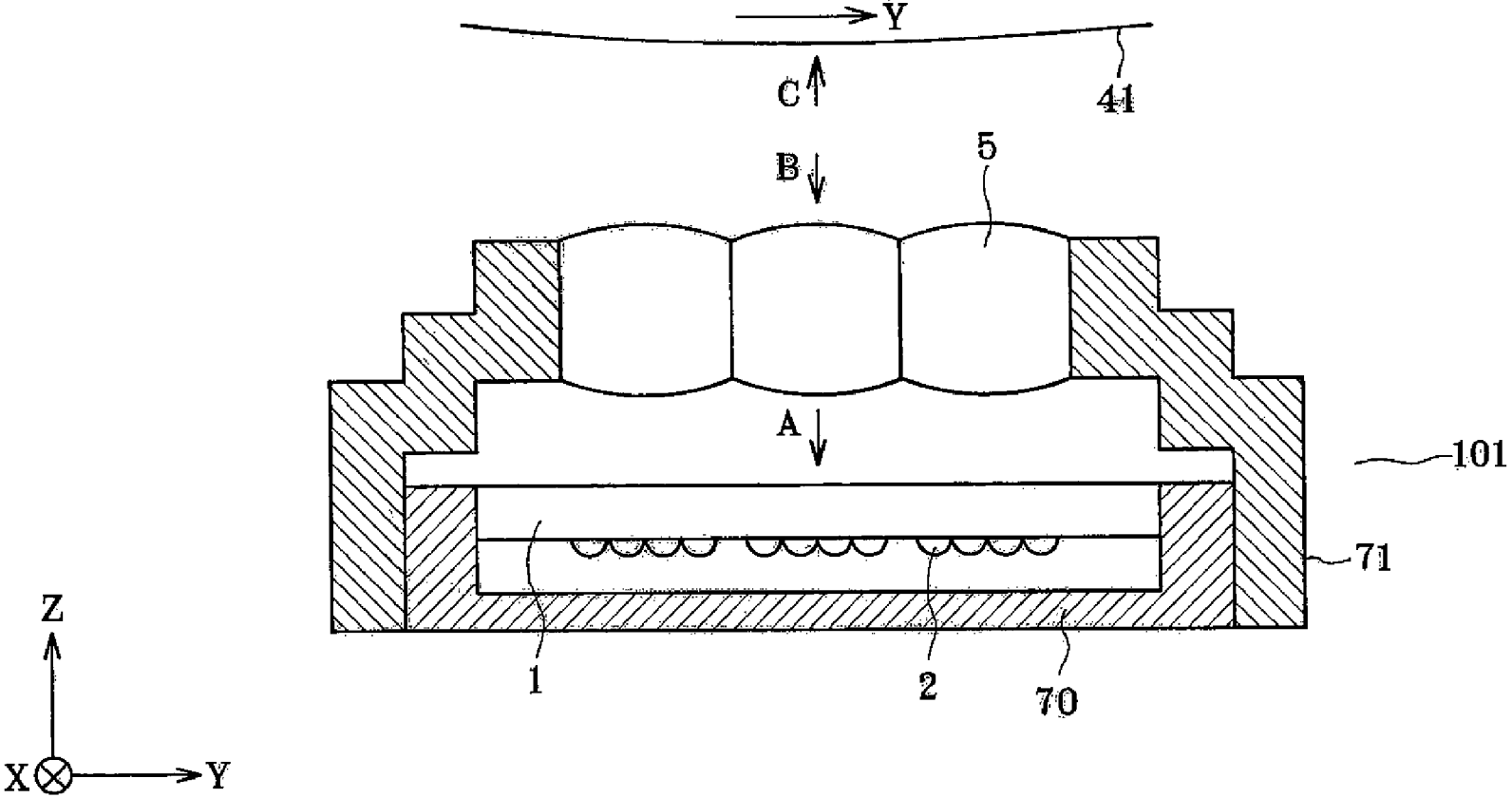
FIG. 11 is an illustration showing the embodiment of the invention.

FIG. 11 is an illustration showing the relation between the line head, shown in cross section, and the image carrier 41. The light emitter array 1 in which the plural light emitting elements 2 are arranged in the main scanning direction and the sub scanning direction is mounted on a casing 70 and is fixed to a holder 71 together with the microlens 5. A, B, and C designate viewing locations. FIG. 9 is a view taken from the viewing location B so that the microlens 5 is shown by solid lines.

Figure 10:
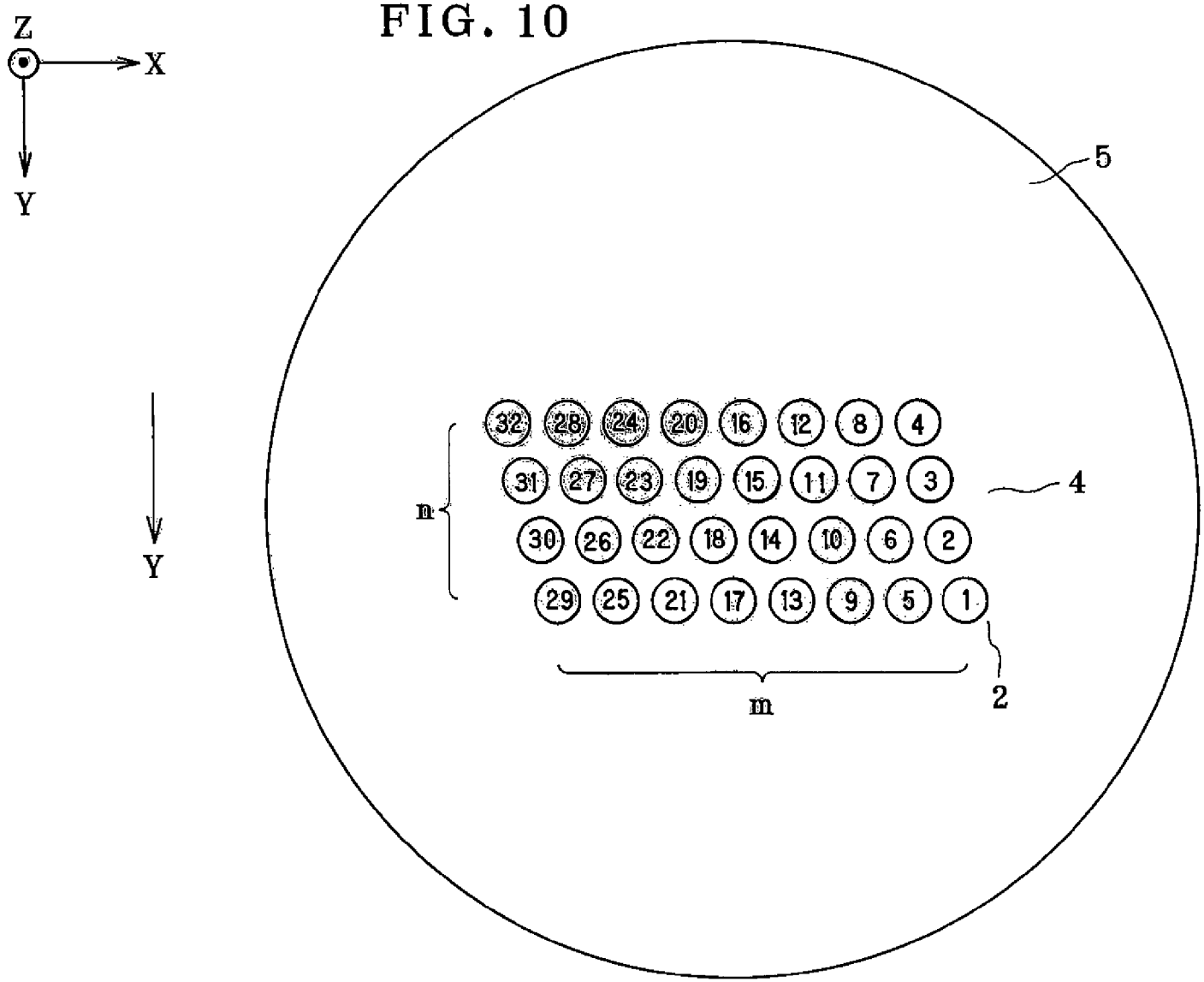
FIG. 10 is an illustration showing the embodiment of the invention.

FIG. 10 is an enlarged view as an illustration showing light emitting elements arranged relative to a single microlens 5 among the plural microlens shown in FIG. 9. In FIG. 10, the respective light emitting elements are marked with numbers 1 through 32. As described in the above, eight light emitting elements 2 are aligned in the main scanning direction to form a light emitting element line. The light emitting element lines are four in the sub scanning direction. In this embodiment, the number of the light emitting elements in the main scanning direction: m=8 and the number of the light emitting element lines in the sub scanning direction: n=4, so that the light emitting elements of which number is m×n are arranged two-dimensionally relative to each microlens 5. In the embodiment of the invention, the m×n-th ($32^{nd}$ in the example shown in FIG. 10) light emitting element in the light emitter block is arranged at the foremost side in the axial direction of the light emitter array and on the first line (the upstream side in the moving direction of the image carrier) in a direction perpendicular to the axial direction. The first light emitting element in the light emitter block is arranged at the aftermost side in the axial direction and on the n-th line (the downstream side in the moving direction of the image carrier) in the direction perpendicular to the axial direction.

The numbers 1 through 32 marked on the respective light emitting element in FIG. 10 are different from the numbers as described with reference to FIG. 2. In FIG. 2, the light emitting element at the left end in the main scanning direction and on the light emitting element line of the upper side in the sub scanning direction is marked with number 1 and the light emitting element at the left end of the light emitting element line below the light emitting element of number 1 in the sub scanning direction is marked with number 2. In the example of FIG. 10, however, the light emitting element at the right end in the main scanning direction and on the light of the lower side in the sub scanning direction is marked with number 1 and the light emitting element at the right end of the light emitting element line above the light emitting element of number 1 in the sub scanning direction is marked with number 2. This is because FIG. 10 is an illustration taken from the viewing location B of FIG. 11, that is, taken through the microlens 5 so that the positions of the light emitting elements are inversed in the main scanning direction and the sub scanning direction.

Figure 12:
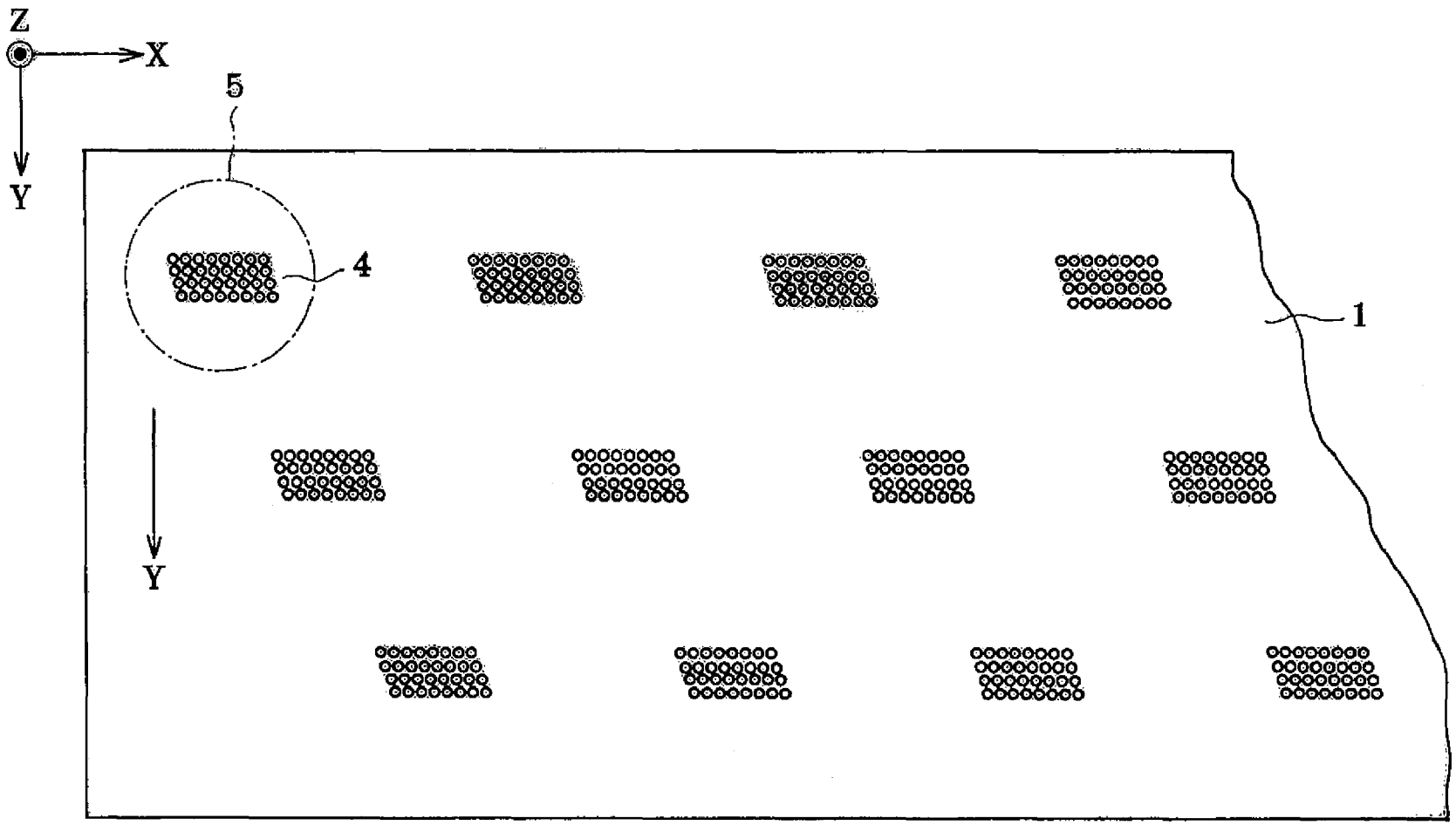
FIG. 12 is an illustration showing the embodiment of the invention.
Figure 13:
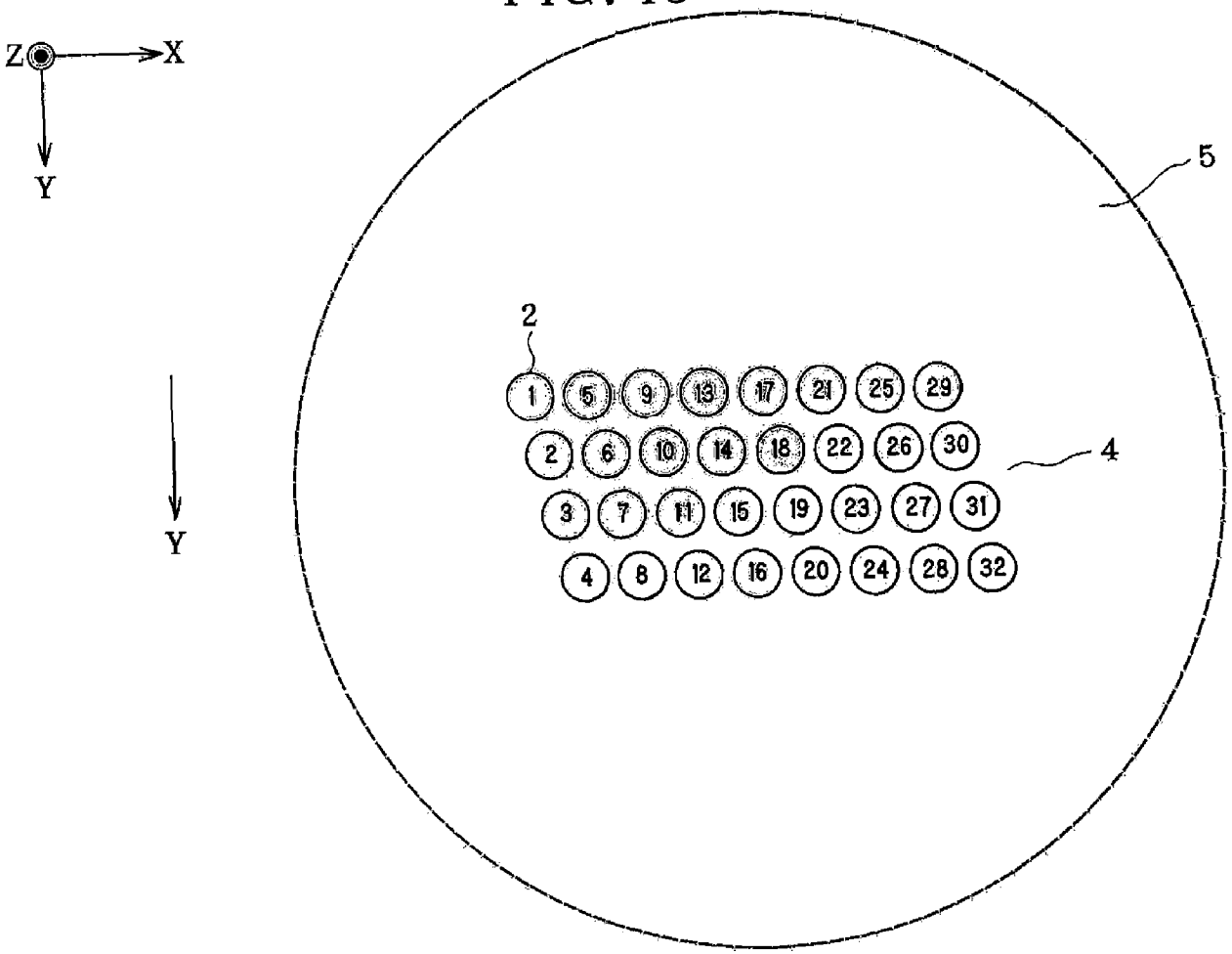
FIG. 13 is an illustration showing the embodiment of the invention.

FIG. 12 and FIG. 13 are illustrations of the light emitter array taken from the viewing location A of FIG. 11. The alignment order of the respective light emitting elements marked with 1 through 32 is the same as the example described with reference to FIG. 2, that is, the light emitting element at the left end in the main scanning direction and on the light emitting element line of the upstream side in the sub scanning direction is marked with number 1. Because of this alignment order of the light emitting elements, consistency with the memory storing image data is ensured, thereby smoothly forming the focused spots on the image carrier. The arrangement of the memory will be described later with regard to FIG. 19 and FIG. 20.

Figure 14:
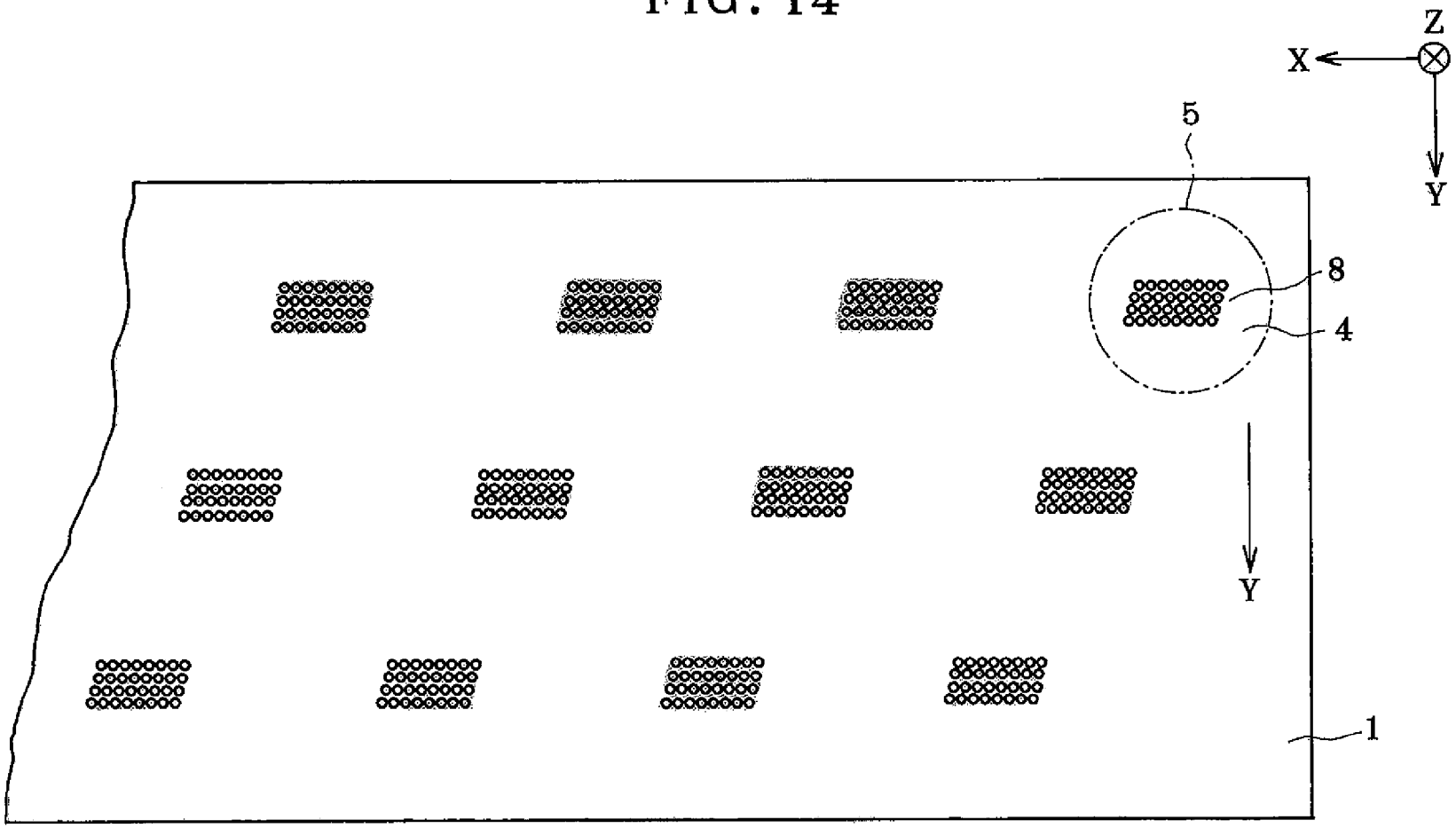
FIG. 14 is an illustration showing the embodiment of the invention.
Figure 15:
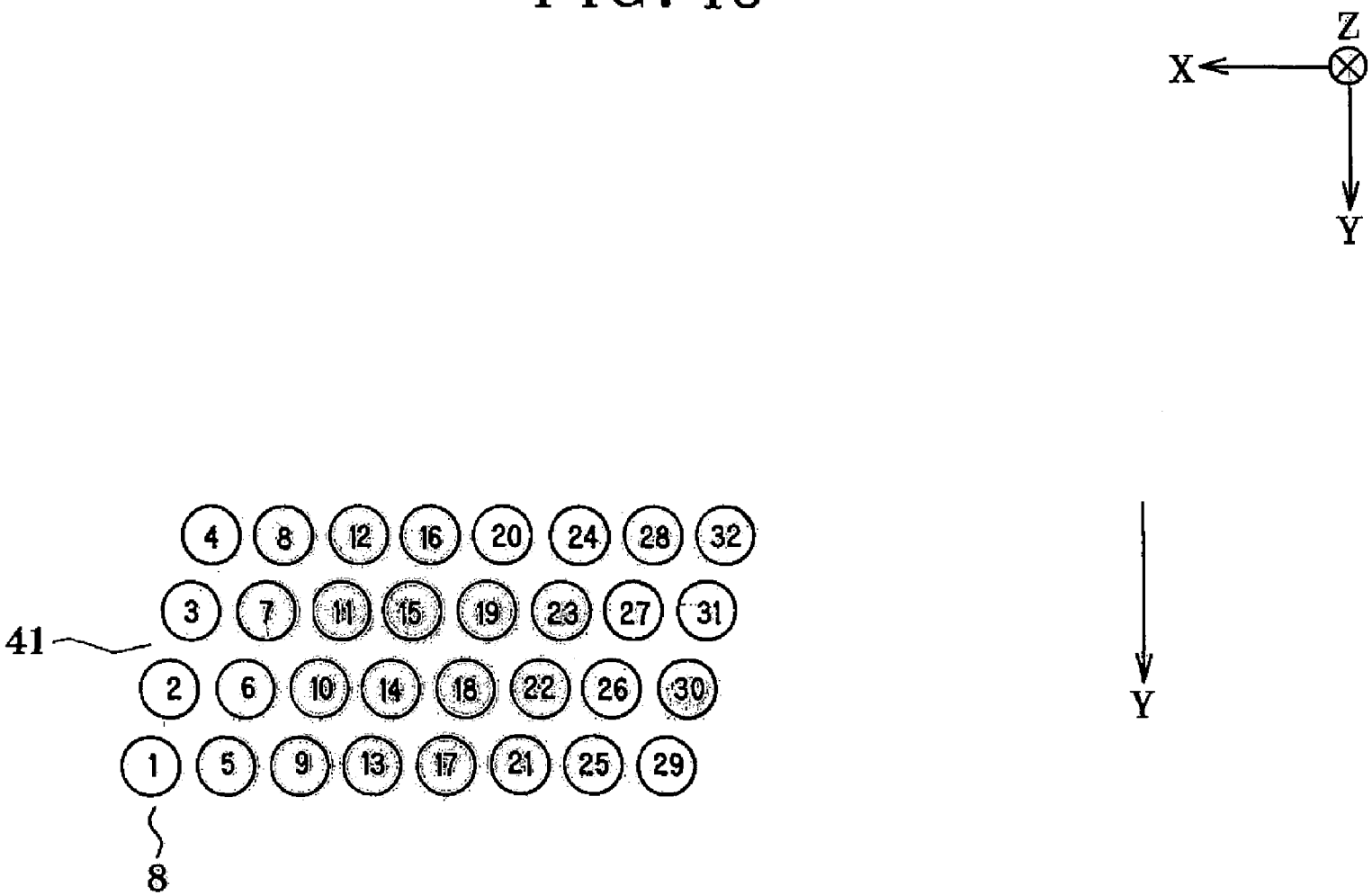
FIG. 15 is an illustration showing the embodiment of the invention.

FIG. 14 is an illustration taken from the viewing location C of FIG. 11, assuming that the light emitter array 1 is projected to the image carrier 41. FIG. 15 is a partially enlarged view of FIG. 14. On the output side of the microlens 5, the light emitting elements seem to be arranged in the order of number from 1 to 32 as described with reference to FIG. 13. Therefore, the positions of the focused spots formed on the image carrier 41 are inversed in the main scanning direction and the sub scanning direction from the state shown in FIG. 13, that is, are arranged as shown in FIG. 15.

Figure 16:
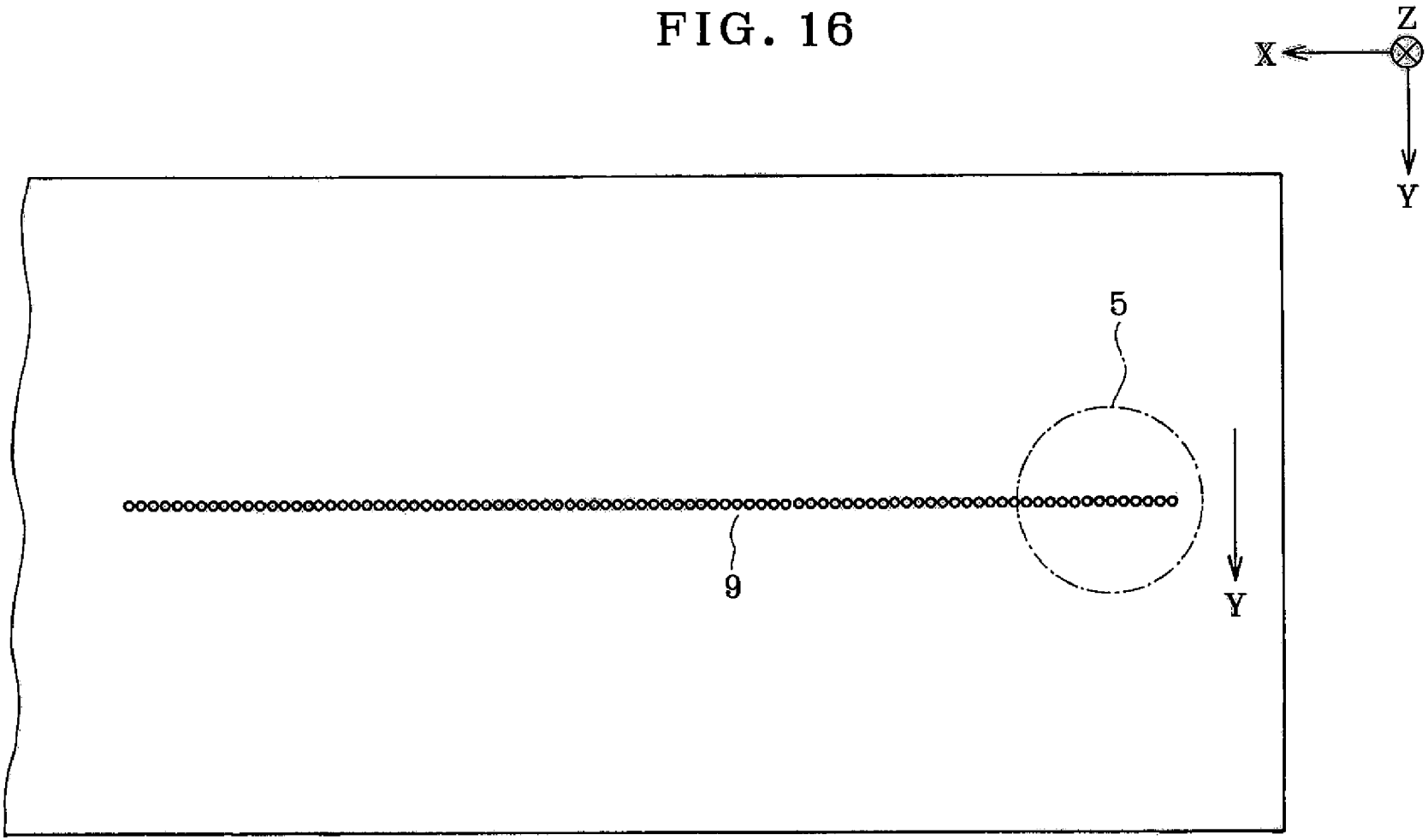
FIG. 16 is an illustration showing the embodiment of the invention.

The focused spots 9 should be aligned in a single line in the main scanning direction as shown in FIG. 16. In the embodiment of the present invention, when the light emitting elements 1 through 32 are arranged in the order shown in FIG. 10 relative to the microlens 5 of the light emitter array 1, image data are stored in the memory in such a manner that focused spots 9 are aligned in a single line in the main scanning direction as shown in FIG. 17 in the order of number from 1 to 32. Focused spots marked with 62 through 64 are focused spots formed by light emitting elements which are arranged relative to an adjacent microlens.

FIG. 18 is a flow chart showing a procedure of the invention. Hereinafter, description will now be made as regard to this flow chart. As the procedure is started (S1), it is determined whether or not printing is about to start (S2). If the determination result is No, the procedure is terminated. If the determination result is Yes, a controller transmits video data (image data) for a single line in the main scanning direction to the control unit (S3). Then, the video data for the single line to be formed in the main scanning direction on the image carrier are stored in the line buffer memory (S4).

Assuming that four light emitting element lines are provided in the sub scanning direction as shown in FIG. 10, only video data corresponding to the $4^{th}$ light emitting element line are read out from the line buffer memory and are transmitted to the line head (S5). After that, respective video data corresponding to $3^{rd}$ through $1^{st}$ light emitting element lines are read out from the line buffer memory and are transmitted to the line head (S6 through S8). It is determined whether or not the printing is finished (S9). If the determination result is Yes, the procedure is terminated. If the determination result is No, the procedure is returned to the step S3 and the loop handling from S3 to S9 is repeated.

Figure 19A:
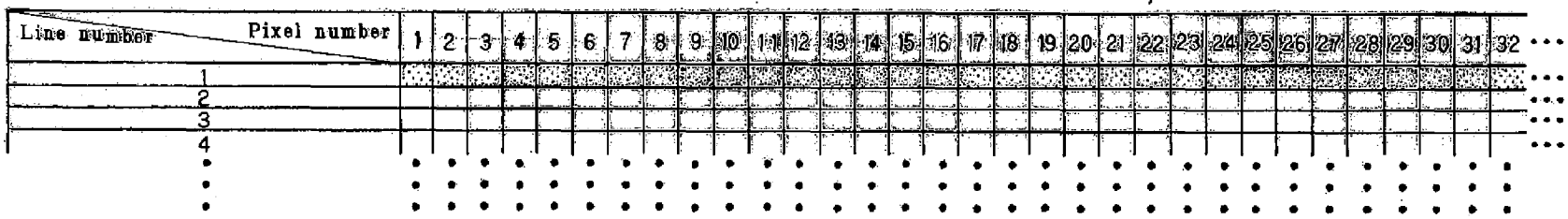
FIGS. 19(*a*)-(*c*) are illustrations showing an embodiment of the invention.
Figure 19B:
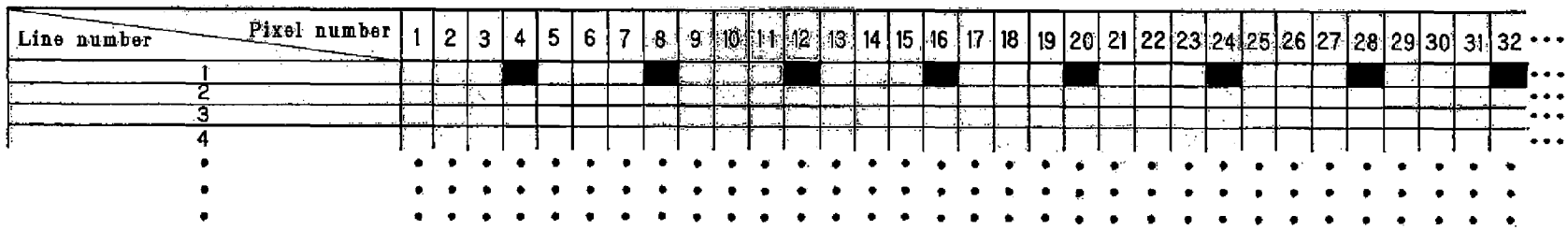
Figure 19C:
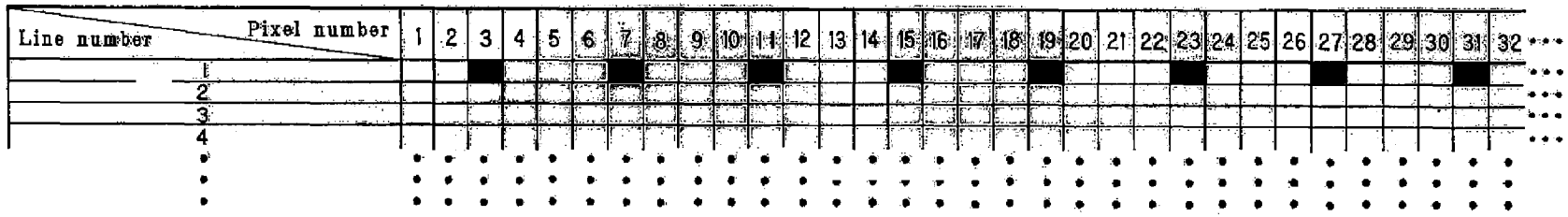
Figure 20D:
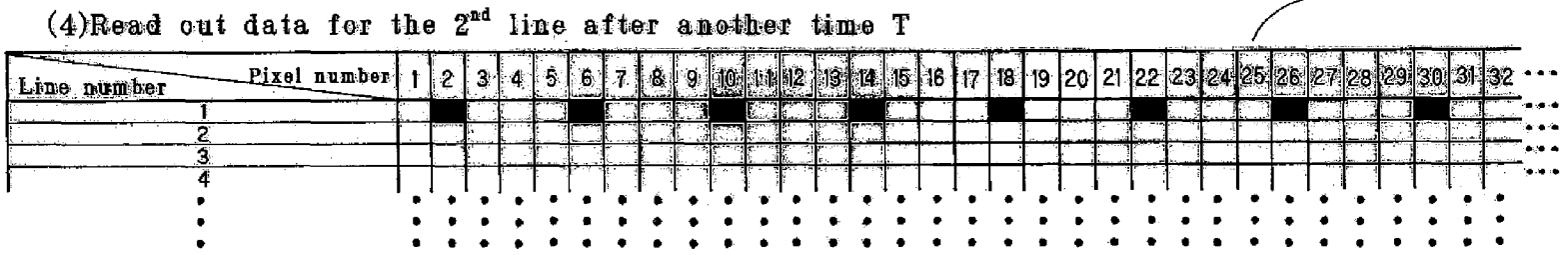
FIGS. 20(*d*)-(*f*) are illustrations showing the embodiment of the invention.
Figure 20E:
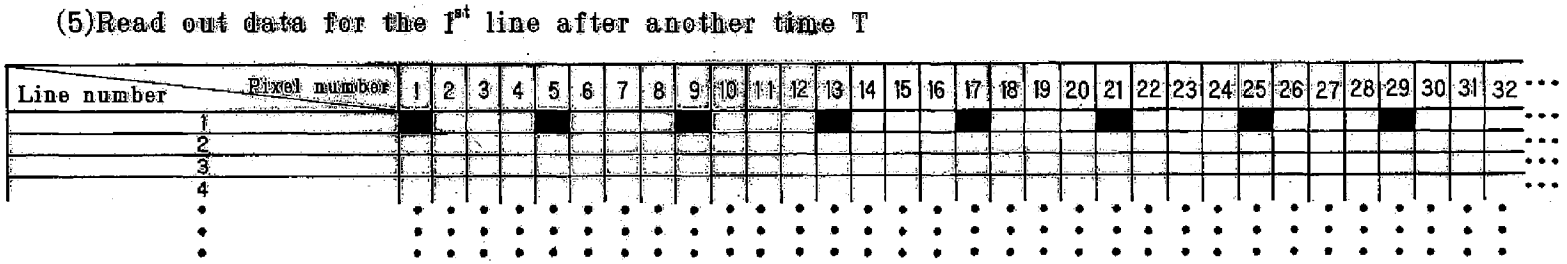
Figure 20F:
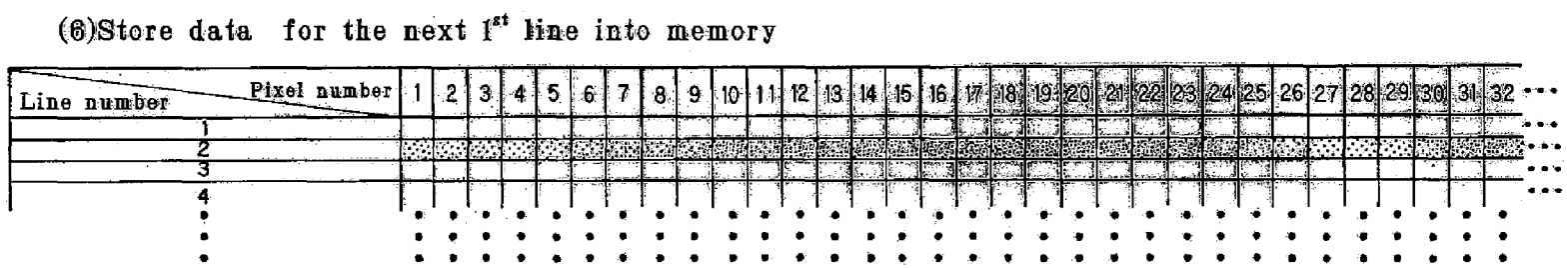

FIG. 19(*a*) through FIG. 20(*f*) are illustrations showing an example of the table 10 for storing video data (image data) provided in the line buffer memory. Hereinafter, description will be made as regard to memory control. The pixel number 1 in the column index of the table 10 corresponds to an image datum at a writing start position in the main scanning direction (the longitudinal direction) of the image carrier. The row index as the vertical index of the table 10 indicates numbers of image data to be written in the sub scanning direction (the moving direction) of the image carrier. Now, the writing order and read-out order of the table 10 will be described. (a) Video data (image data) for a single line in the main scanning direction are stored in the line buffer memory. (b) Only video data (4, 8, . . . ) corresponding to the light emitting elements on the $4^{th}$ line are read out from the line buffer memory.

(c) After a time T, only video data (3, 7, . . . ) corresponding to the light emitting elements on the $3^{rd}$ line are read out from the line buffer memory. (d) Further after a time T, only video data (2, 6, . . . ) corresponding to the light emitting elements on the $2^{nd}$ line are read out from the line buffer memory. (e) Further after a time T, only video data (1, 5, . . . ) corresponding to the light emitting elements on the $1^{st}$ line are read out from the line buffer memory. (f) Video data for the next line in the main scanning direction are stored in the line buffer memory. As mentioned above, in the embodiment of the present invention, the control means reads out image data stored in the table of the memory in the order of n-th line, (n−1)-th line, . . . $1^{st}$ line of the light emitter block to actuate the corresponding light emitting elements so as to form images aligned in a single line in the axial direction of the image carrier.

Now, the memory control as shown in FIG. 19(*a*) through FIG. 20(*f*) by the control unit will be described with reference to a concrete example. In this example, the light emitter block described with reference to FIG. 2 is represented as "group". (a) Based on a signal identifying groups, light emitting timing for each group is determined. (b) Image data in each group are counted and light emitting elements in each group are sorted by lines based on the counted value (n-th line, (n−1)-th line, . . . in the sub scanning direction). (c) Based on identifying signals for identifying lines and the image data counted value, the inversion in the X axis (main scanning direction) and the Y axis (sub scanning direction) is determined. (d) Based on horizontal synchronizing (Hsync) signals, group identifying signals and line identifying signals, and the inversion circuit control, writing addresses in the line buffer memory are determined. (e) Based on the Hsync signals, the group identifying signals and the line identifying signals, and the inversion circuit control, read-out addresses in the line buffer memory are determined.

Figure 21:
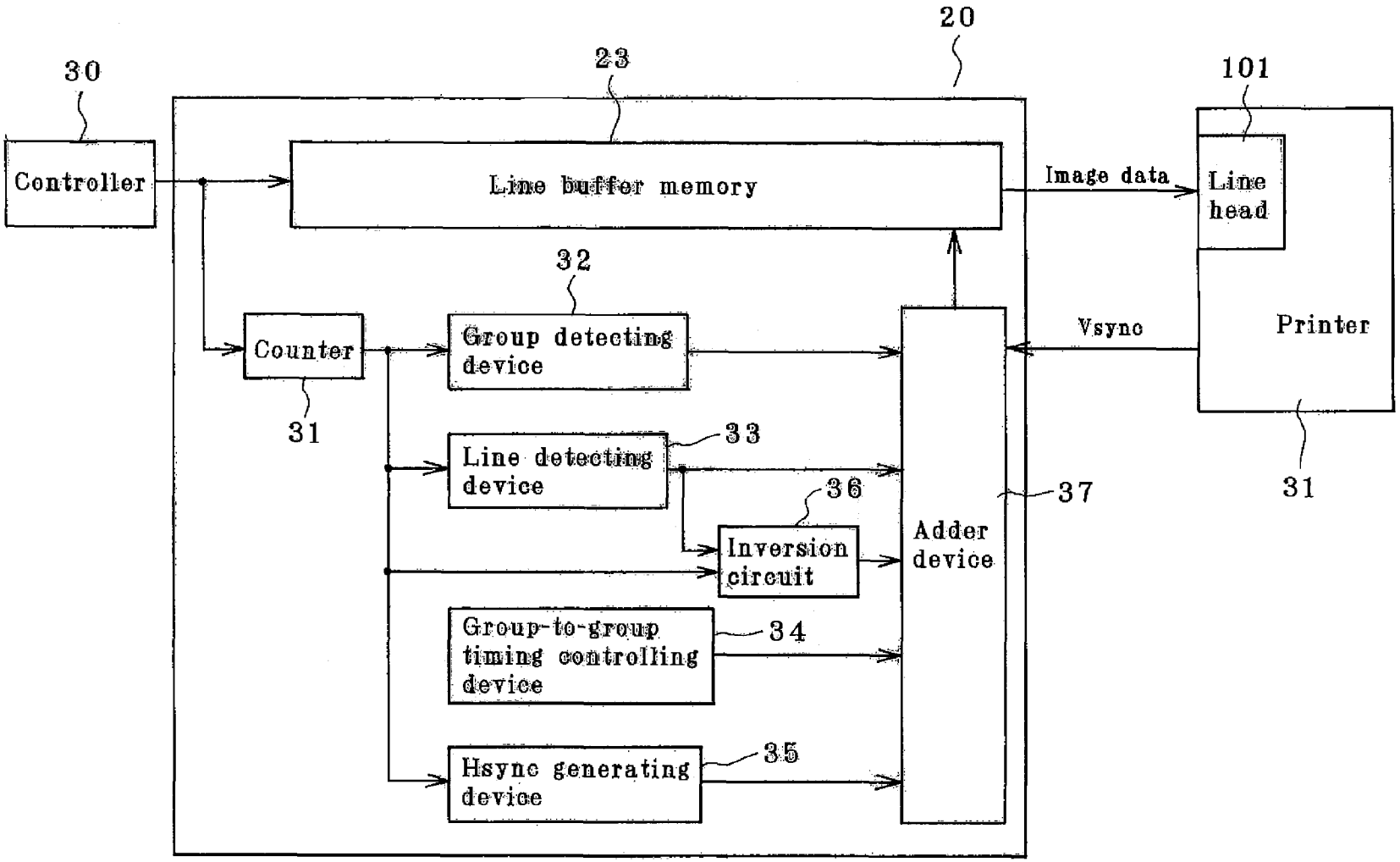
FIG. 21 is a block diagram showing an embodiment of the invention.
Figure 22:
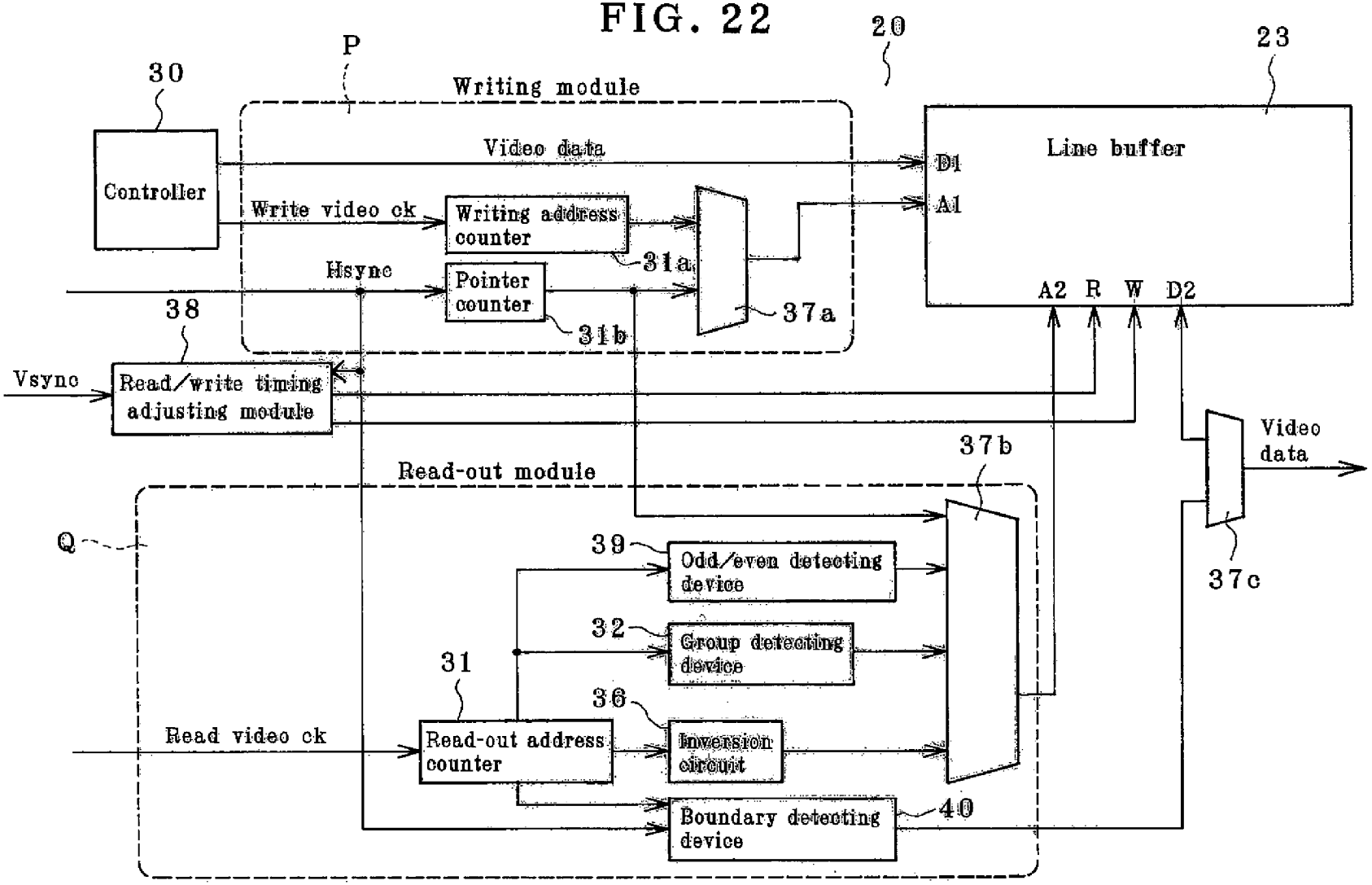
FIG. 22 is a block diagram showing an embodiment of the invention.

FIG. 21 and FIG. 22 are block diagrams showing examples of the control unit for the line head of the present invention. In FIG. 21, the controller 30 transmits image data to the line buffer 23 of the control unit 20 as described with reference to FIGS. 19(*a*)-(*c*). The image data (video data) stored in the line buffer 23 are read out, starting from the data for the $4^{th}$ line in the sub scanning direction, and transmitted to the line head 101 in the printer 31.

The control unit 20 comprises a counter 31 for counting image data in a light emitter block (group) formed in the sub scanning direction, a group detecting device 32 for detecting a light emitter block, an inversion circuit 36 for inverting an image for each light emitter block, a group-to-group timing controlling device 34 for controlling a light emitting timing between light emitter blocks, a line detecting device (not shown) for detecting the number of lines in the light emitting element group (light emitter block), a line timing controlling device (not shown) for controlling a light emitting timing between lines of the light emitter block, a line buffer memory 23 for storing image data only for a time of the aforementioned timing, a horizontal synchronizing (Hsync) signal generating device 35, and an adder device 37.

The actions of the controlling unit 20 will be described, that is, as follows: (a) conducting group detection based on a group detecting signal from the controller 30; (b) generating a group detecting signal based on a counted value of pixels of image data by the counter 31; (c) making the inversion circuit 36 to conduct the inversion process of the light emitter block based on group identifying signals; (d) making the inversion circuit 36 to conduct the inversion process in both the X axis (the main scanning direction) and the Y axis (the sub scanning direction); (e) determining a light emitting timing for the light emitting element group based on the group identifying signals and the Hsync signals; (f) determining light emitting timings for the other light emitting element groups based on the light emitting timing for the first light emitting element group; and (g) adjusting the light emitting timing between light emitting element groups at a frequency higher than the image data clock frequency.

FIG. 22 is a block diagram showing a writing module P and a read-out module Q of the control unit 20 described with reference to FIG. 21. In FIG. 22, the controller 30 for transmitting video data, the writing module P for controlling the writing address, the read-out module Q for controlling the read-out address, read/write timing adjusting module 38 for controlling the entire writing/read-out timing, and the line buffer memory 23 for storing the video data are shown.

The writing module P comprises a writing address counter 31*a* to be driven by video clock, a pointer counter 31*b* to be driven by Hsync signals, and an adder device 37*a*. Based on the counted values of the counters 31*a*, 31*b*, the video data from the controller 30 are written in predetermined addresses of the line buffer memory 23.

Then, the read-out module Q comprises a read-out address counter 31, a group detecting device 32 for controlling offset amount between groups (light emitter blocks) based on the counted value of the read-out video clock, an inversion circuit 36 for detecting each group and controlling the inversion for each group, an odd/even detecting device 39 for controlling the detection of odd-numbered elements and even-numbered elements, a boundary detecting device 40 for counting the read-out video clock and Hsync signals and controlling boundary data for an end of image, and an adder device 37*b*.

The adder device 37*b* controls the entire read-out timing based on output signals from the group detecting device 32, and the inversion circuit 36, the odd/even detecting device 39 and the counted value of Hsync signals by the pointer counter 31*b*. When the image data are stored in the line buffer memory 23, the light emitting timing for each group may be adjusted to conduct image inversion. In addition, the light emitting timing for each group may be adjusted finely compared to the video clock, thereby enabling further fine timing adjustment. In case of compensating the inclination of the line head, it is better to adjust the light emitting timing for each group to conduct image inversion before the compensation of the inclination because the algorism becomes not so complex.

Figure 23:
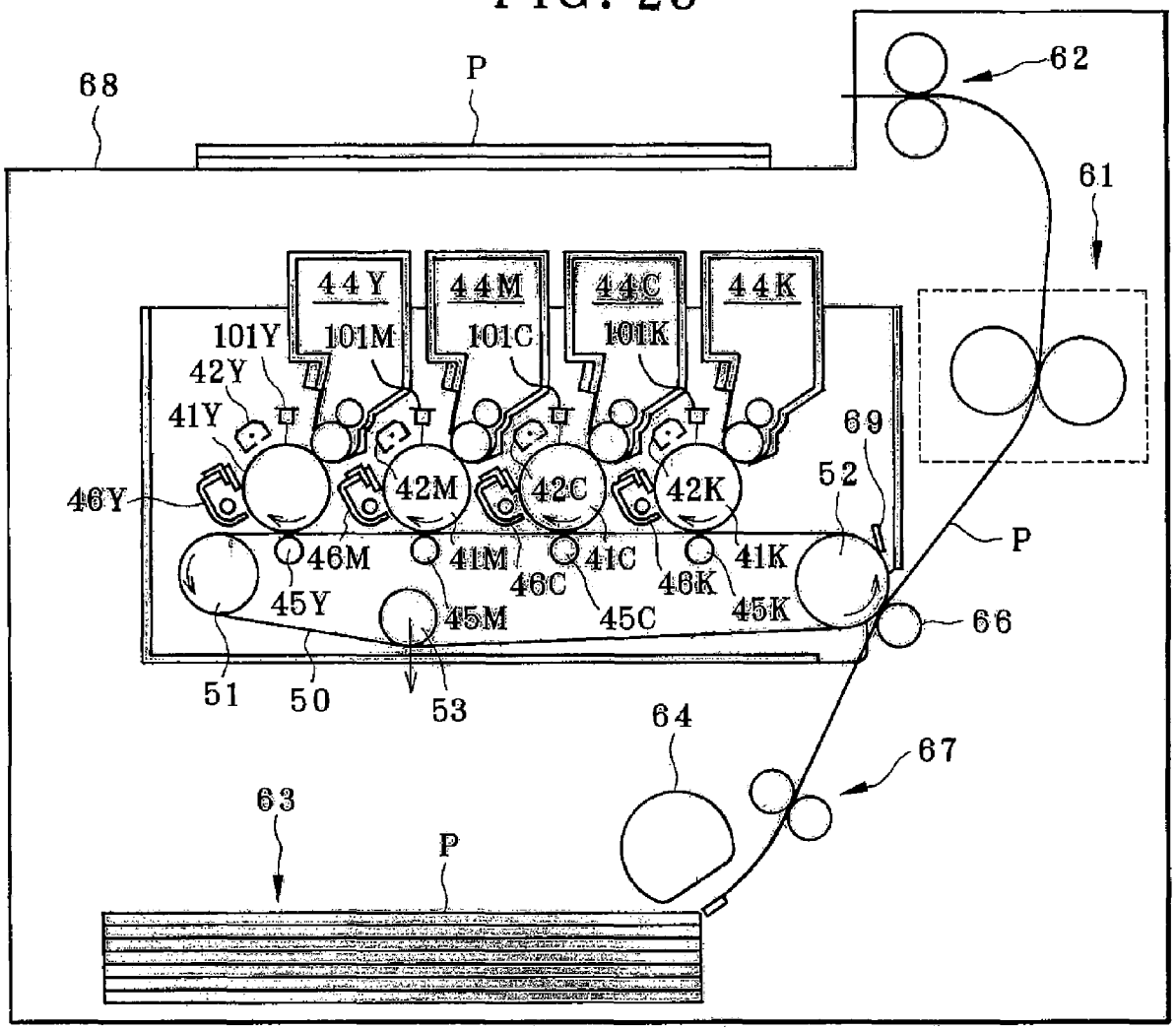
FIG. 23 is a schematic sectional view showing the entire structure of an embodiment of an image forming apparatus using an electrophotographic process of the invention.

The embodiment of the invention addresses a line head to be used in a tandem-type color printer (image forming apparatus) in which four photoreceptors are exposed to light by four line heads to form images of four colors at once and the images are transferred to a single endless intermediate transfer belt (intermediate transfer medium). FIG. 23 is a vertical sectional view showing an example of a tandem-type color printer using organic EL elements as light emitting elements. The image forming apparatus is a tandem-type image forming apparatus comprising four light emitter arrays (line heads) 101K, 101C, 101M, 101Y having the same structure, and four photoreceptive drums (image carriers) 41K, 41C, 41M, 41Y having the same structure and corresponding to the four light emitter arrays, respectively. The light emitter arrays 101K, 101C, 101M, 101Y are located at positions for exposing the photoreceptive drums 41K, 41C, 41M, 41Y.

As shown in FIG. 23, the image forming apparatus comprises a driving roller 51, a driven roller 52, a tension roller 53, and an intermediate transfer belt (intermediate transfer medium) 50 which is laid to extend with being tensioned by the tension roller 53 and is driven to circulate in the direction of arrows (the counter-clockwise direction). The photoreceptors 41K, 41C, 41M, 41Y as the four image carriers each having a photosensitive layer on its outer surface are arranged relative to the intermediate transfer belt 50 at predetermined intervals.

The alphabetic characters K, C, M, and Y added after the aforementioned reference numerals indicate black, cyan, magenta, and yellow, respectively so that the photoreceptors 41K, 41C, 41M, and 41Y are photoreceptors for black, cyan, magenta, and yellow, respectively. The same is true for the other components. The photoreceptors 41K, 41C, 41M, 41Y are driven to rotate in the direction of arrows (the clockwise direction), wherein the driving is synchronized with the driving of the intermediate transfer belt 50. Arranged around each photoreceptor 41 (K, C, M, Y) are a charging means (corona charger) 42 (K, C, M, Y) for uniformly charging the outer surface of the photoreceptor (K, C, M, Y) and a light emitter array (line head) 101 (K, C, M, Y), as mentioned above as the embodiment of the invention, of which driving is synchronized with the photoreceptor 41 (K, C, M, Y) to sequentially scan lines.

Also arranged around each photoreceptor 41 (K, C, M, Y) are a developing device 44 (K, C, M, Y) for applying toner as developer to an electrostatic latent image formed by the light emitting array (line head) 101 (K, C, M, Y) to form a visible image (toner image), a primary transfer roller 45 (K, C, M, Y) as a transfer means for sequentially transferring the toner image, developed by the developing device 44 (K, C, M, Y), to the intermediate transfer belt 50 as an object for primary transfer, and a cleaning device 46 (K, C, M, Y) as a cleaning means for removing toner remaining on the surface of the photoreceptor 41 (K, C, M, Y) after the transfer.

The light emitter array (line head) 101 (K, C, M, Y) is arranged such that the array direction of the light emitter array exposure head 101 (K, C, M, Y) extends along the generating line of the photoreceptive drum 41 (K, C, M, Y). The light emitter array (line head) 101 (K, C, M, Y) and the photoreceptor 41 (K, C, M, Y) are designed such that the emission energy peak wavelength of the light emitter array (line head) 101 (K, C, M, Y) and the sensitivity peak wavelength of the photoreceptor 41 (K, C, M, Y) substantially coincide with each other.

In the developing device 44 (K, C, M, Y), for example, a nonmagnetic single component toner is used as the developer. The developing device 44 (K, C, M, Y) transfers the single component toner to a development roller by a supply roller, for example, regulates the thickness of a developer layer on the surface of the development roller, and brings the development roller in contact with or to be pressed against the photoreceptor 41 (K, C, M, Y) to make the developer to adhere the photoreceptor 41 (K, C, M, Y) according to the potential level, thereby forming a toner image.

Toner images of black, cyan, magenta, and yellow, formed by unicolor toner image forming stations for the four colors, are sequentially transferred to the intermediate transfer belt 50 by primary transfer bias applied to the primary transfer rollers 45 (K, C, M, Y) and thus are sequentially superposed on the intermediate transfer belt 50 so as to form a full-color toner image. The full-color toner image is secondarily transferred to a recording medium P such as a paper by a secondary transfer roller 66 and is fixed to the recording medium P by passing through a fixing roller pair 61 as a fixing device. The recording medium P with the image is discharged onto a catch tray 68 formed at the top of the apparatus by a discharging roller pair 62.

In FIG. 23, a numeral 63 designates a feeder cassette in which a number of recording media P are stacked, a numeral 64 designates a pick-up roller for feeding the recording media P one by one from the feeder cassette 63, a numeral 67 designates a gate roller pair for regulating the timing of feeding the recording media P to a secondary transfer section with the secondary transfer roller 66, a numeral 66 designates the secondary transfer roller as a secondary transfer means which cooperates with the intermediate transfer belt 50 to form the secondary transfer section therebetween, and a numeral 69 designates a cleaning blade as a cleaning means for removing toner remaining on the surface of the intermediate transfer belt 50 after the secondary transfer.

Though the image forming apparatus and the image forming method of the invention have been described based on its principle and the embodiments, the invention is not limited to these embodiments and various modifications may be made.

What is claimed is:

1. An image forming method, wherein line heads are provided relative to respective colors, each line head comprising a plurality of lenses of which optical magnification is minus and which are arranged in an axial direction of an image carrier and in a direction perpendicular to said axial direction and light emitter blocks each disposed relative to each lens, each light emitter block being composed of "m×n" (in number) light emitting elements, said "m×n" light emitting elements aligned in "n" (in number) light emitting element lines arranged in the direction perpendicular to the axial direction, each light emitting element line including "m" (in number) light emitting elements aligned in the axial direction, said image forming method comprising the following steps of:

storing image data in a storing means in such a manner as to form images to be sequentially aligned in a single line along the axial direction from a writing start position in the axial direction of said image carrier and to form a plurality of said single lines in the direction perpendicular to said axial direction;

reading out the image data stored in said storing means in such a manner as to form a latent image while sequentially turning on said light emitting elements starting from the downstream side in the moving direction of said image carrier;

actuating light emitting elements according to said read out image data to emit lights to be inversed in said axial direction and the direction perpendicular to the axial direction; and forming images of four colors at once by exposing a plurality of said image carriers to light from said line heads each provided in each of said image carriers.

2. An image forming method as claimed in claim 1, wherein said image data are read out in the order of the (n)-th line, the (n−1)-th line, the 1st line of each light emitter block.

* * * * *